US011310585B2

(12) United States Patent
Della Rosa et al.

(10) Patent No.: US 11,310,585 B2
(45) Date of Patent: Apr. 19, 2022

(54) COMPACT SPEAKER

(71) Applicant: Apple Inc., Cupertino, CA (US)

(72) Inventors: Jason C. Della Rosa, Morgan Hill, CA (US); Alexander R. Gould, Campbell, CA (US); Ethan W. Juhnke, Mountain View, CA (US); John H. Sheerin, Santa Clara, CA (US); Glenn K. Trainer, Santa Clara, CA (US); Ariel A. Massias, San Francisco, CA (US); Edward V. Anderson, San Francisco, CA (US); Pablo Seoane Vieites, San Jose, CA (US); Junyi Yang, Fremont, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/067,611

(22) Filed: Oct. 9, 2020

(65) Prior Publication Data

US 2022/0070576 A1 Mar. 3, 2022

Related U.S. Application Data

(60) Provisional application No. 63/074,230, filed on Sep. 3, 2020.

(51) Int. Cl.
*H04R 1/28* (2006.01)
*H04R 5/02* (2006.01)
(Continued)

(52) U.S. Cl.
CPC ..... *H04R 1/2803* (2013.01); *H04R 1/02* (2013.01); *H04R 5/02* (2013.01); *H04R 9/06* (2013.01)

(58) Field of Classification Search
CPC . H04R 1/00; H04R 1/02; H04R 1/021; H04R 1/023; H04R 1/025; H04R 1/026;
(Continued)

(56) References Cited

U.S. PATENT DOCUMENTS 4,365,779 A 12/1982 Bates et al.
4,554,590 A 11/1985 Chelin et al.
(Continued)

FOREIGN PATENT DOCUMENTS

CN 110896515 3/2020
WO 2010031229 3/2010

OTHER PUBLICATIONS

Notice of Allowance issued in U.S. Appl. No. 17/067,617, dated Oct. 18, 2021 in 10 pages.
(Continued)

*Primary Examiner* — Walter F Briney, III
(74) *Attorney, Agent, or Firm* — Kilpatrick Townsend & Stockton LLP

(57) ABSTRACT

An electronic speaker comprising: a device housing defining an interior cavity and including a sidewall extending around the interior cavity between an upper portion and a lower portion of the device housing; first and second sound channels formed at opposing locations along the sidewall, each of the first and second sound channels comprising a plurality of openings formed through the sidewall; a passive radiator array comprising first and second passive radiators disposed within the interior cavity, spaced apart from each other in an opposing relationship and aligned to project sound through the first and second sound channels; an active driver disposed in the device housing and configured to generate sound in response to an electrical signal, the active driver comprising driver housing disposed at least partially between the first and second passive radiators, a magnet
(Continued)

disposed within the driver housing, a voice coil and a diaphragm facing downwards towards the lower surface of the device housing; and an annular sound channel disposed along the bottom portion of the device housing adjacent to the diaphragm of the active driver.

20 Claims, 23 Drawing Sheets

(51) Int. Cl.
*H04R 1/02* (2006.01)
*H04R 9/06* (2006.01)

(58) Field of Classification Search
CPC ... H04R 1/20; H04R 1/24; H04R 1/28; H04R 1/2807; H04R 1/2811; H04R 1/2815; H04R 1/2819; H04R 1/2823; H04R 1/2826; H04R 1/283; H04R 1/2834; H04R 1/2838; H04R 1/2842; H04R 1/2846; H04R 1/2849; H04R 1/2869; H04R 1/2884; H04R 1/2888; H04R 1/2892; H04R 1/2896; H04R 1/32; H04R 1/323; H04R 1/34; H04R 1/345; H04R 1/347; H04R 2201/00; H04R 2201/02; H04R 2201/028; H04R 2201/029; H04R 2205/00; H04R 2205/021
See application file for complete search history.

(56) References Cited

U.S. PATENT DOCUMENTS

| | | | | |
|---|---|---|---|---|
| 5,947,440 | A | 9/1999 | Cho | |
| 6,217,137 | B1 | 4/2001 | Bitbaba et al. | |
| 7,970,160 | B2 | 6/2011 | Hiramoto | |
| 10,462,557 | B1 | 10/2019 | Chan | |
| 10,524,044 | B2 | 12/2019 | Sheerin et al. | |
| 10,587,950 | B2 | 3/2020 | Huwe et al. | |
| 10,609,473 | B2 | 3/2020 | Stanley et al. | |
| 10,631,071 | B2 | 4/2020 | Wu et al. | |
| 10,697,583 | B2 | 6/2020 | Law et al. | |
| 10,771,890 | B2 | 9/2020 | Stanley et al. | |
| 10,861,303 | B2 | 12/2020 | Mehdi et al. | |
| 11,206,470 | B1 | 12/2021 | Gould et al. | |
| 2001/0019096 | A1 | 9/2001 | Andreoli et al. | |
| 2005/0157900 | A1* | 7/2005 | Litovsky | H04R 31/003 381/349 |
| 2007/0068729 | A1 | 3/2007 | Chen | |
| 2012/0279796 | A1* | 11/2012 | Lin | H04R 7/24 181/148 |
| 2016/0131300 | A1 | 5/2016 | Cornelissen | |
| 2016/0316298 | A1 | 10/2016 | Ohura | |
| 2018/0087767 | A1 | 3/2018 | Trainer et al. | |
| 2018/0091878 | A1 | 3/2018 | Della Rosa et al. | |
| 2018/0220213 | A1* | 8/2018 | Wu | H04R 1/403 |
| 2018/0288525 | A1 | 10/2018 | Katz et al. | |
| 2019/0090049 | A1* | 3/2019 | Xie | H04R 1/345 |
| 2021/0304744 | A1 | 9/2021 | Pawar et al. | |

OTHER PUBLICATIONS

Notice of Allowance issued in U.S. Appl. No. 17/067,617, dated Nov. 10, 2021 in 2 pages.
Partial European Search Report issued in European Application No. EP21161376.5, dated Aug. 20, 2021 in 14 pages.
Extended European Search Report issued in European Application No. EP21161376.5, dated Nov. 26, 2021 in 16 pages.

* cited by examiner

COMPACT SPEAKER

CROSS REFERENCE TO RELATED APPLICATION

This application claims priority to U.S. Provisional Patent Application No. 63/074,230 filed on Sep. 3, 2020 the disclosures of which is hereby incorporated by reference in its entirety and for all purposes.

FIELD

The present disclosure relates generally to an electronic smart speaker that has a compact size and shape and high quality audio playback.

BACKGROUND

Voice-activated/smart speakers are becoming a common household item where many households have at least one or more such devices. Voice-activated speakers allow a user to listen to and control music playback, access the internet and control various home automation devices in response to voice commands that follow an initial command phrase. While there are a number of different smart speakers on the market, new and improve smart speaker designs are continuously being sought.

BRIEF SUMMARY

This disclosure describes various embodiments of a compact electronic smart speaker. Embodiments of the disclosed smart speaker can have a small footprint while also accurately reproducing music and other audio streams. In some embodiments, the smart speaker can include a supporting foot that has a relatively large surface area, planar bottom surface that distributes the weight of the speaker over a relatively large contact area of a supporting surface (e.g., a table top or desk top) as opposed to multiple smaller contact points of individual feet as is done in some compact speakers. The relatively large contact area of the supporting foot provides a higher degree of protection to the supporting surface that the speaker might be placed on. The foot can include a suspension system that isolates vibrations generated by the speaker, reducing the amount of vibrations that transfer through the foot to the supporting surface thus helping to ensure the speaker does not create an undesirable buzzing or other noise or shift or hop across the supporting surface due to such vibrations.

In some embodiments an electronic speaker is provided. The speaker can include: a device housing that defines an interior cavity and has a sidewall extending around the interior cavity between an upper portion and a lower portion of the device housing; first and second sound channels formed at opposing locations along the sidewall, each of the first and second sound channels having a plurality of openings formed through the sidewall; and a passive radiator array including first and second passive radiators disposed within the interior cavity, spaced apart from each other in an opposing relationship and aligned to project sound through the first and second sound channels. An active driver can be disposed in the device housing and configured to generate sound in response to an electrical signal. The active driver can include a driver housing disposed at least partially between the first and second passive radiators, a magnet disposed within the driver housing, a voice coil and a diaphragm facing downwards towards the lower surface of the device housing. The speaker can further include an annular sound channel disposed along the bottom portion of the device housing adjacent to the diaphragm of the active driver.

In various implementations, the electronic speaker can include one or more of the following features. The device housing can further include a cone-shaped inner sidewall projecting away from a bottom portion of the device housing towards the active driver and the exterior sidewall and the annular sound channel can surround the cone-shaped inner sidewall. The lower portion of the device housing can include a plurality of ribs disposed radially around the device housing and extending from the exterior sidewall towards a bottom surface of the device housing defining a plurality of slits that form the annular sound channel. The plurality of ribs can include a first set of ribs extending from the exterior sidewall to the bottom surface of the device housing and a second set of ribs extending partially between the exterior sidewall and the bottom surface of the device housing. The plurality of ribs can be arranged in an alternating pattern where one or more ribs from the second set of ribs is disposed between each adjacent pair of ribs in the first set of ribs. The device housing can further include a conical inner sidewall projecting away from a bottom surface of the device housing towards the active driver, the annular sound aperture can surround the conical inner sidewall, and each rib in the first set of ribs can include an angled portion adjacent to the bottom surface that extends inward towards the conical inner sidewall. Each rib in the plurality of ribs can be spaced equally apart from its adjacent ribs by a distance between 1.0 to 5.0 millimeters.

In various implementations the electronic speaker can further include one or more of: a touch responsive input device at an upper surface of the device housing, a planar foot coupled to lower portion of the device housing, and/or an acoustic fabric woven in a mesh configuration and wrapped around the device housing providing a consistent exterior surface for the electronic speaker. Also, the device housing can include separate upper housing, middle housing and lower housing components affixed to each other to form the interior cavity. The passive radiator array can include a frame having an annular outer rim extending fully around an outer periphery of the frame and first and second connection members protruding from opposing ends of the outer rim, a rigid diaphragm disposed within a central portion of the frame, a primary annular suspension coupling the diaphragm to the annular outer rim of the frame in a manner that allows the diaphragm to move within the frame, and a radiator mass element having first and second opposing ends and a central section extending along a length of the radiator mass element between the first and second opposing ends, and a secondary suspension coupling the radiator mass element to the frame in a manner that allows the radiator mass to move within the frame. A width of each of the first and second opposing ends of the radiator mass can be greater than a width of the central section. The secondary suspension can include a first spider element coupled between the first connection member of the frame and the first end of the radiator mass, and a second spider element coupled between the second connection end of the frame and the second end of the radiator mass. The central section of the radiator mass element can have a generally concave shape and wherein radiator mass element is coupled to the secondary suspension such that the concave portion of the radiator mass element is facing away from the diaphragm. The first and second spider elements can be formed from a thin sheet of rubber between 1-2 mm thick, and/or each of the first and second spider elements can be thermo-formed into a wavy pattern along a length of the spider. The frame can have a generally oval shape and include first and second connection ends protruding from opposite ends of the frame. The first spider element can be adhered to the first end of the radiator mass element along a first connection portion of the first connection end that has a width greater than a width of the central section, and the second spider element can be adhered to the second end of the radiator mass element along a second connection portion of the second connection end that has a width greater than a width of the central section.

An electronic speaker is provided in some embodiments that can include: a device housing defining an interior cavity and including an exterior sidewall extending around the interior cavity between an upper portion and a lower portion of the device housing; first and second sound channels formed at opposing locations along the exterior sidewall, each of the first and second sound channels including a plurality of openings formed through the exterior sidewall; a passive radiator array including first and second passive radiators disposed within the interior cavity, spaced apart from each other in an opposing relationship and aligned to project sound through the first and second sound channels; an active driver disposed in the device housing and configured to generate sound in response to an electrical signal. The active driver can include a driver housing disposed at least partially between the first and second passive radiators, a magnet disposed within the driver housing, a voice coil and a diaphragm facing downwards towards the lower surface of the device housing. And, the speaker can further include an annular sound channel disposed along the bottom portion of the device housing adjacent to the diaphragm of the active driver, and the device housing can further includes a conical inner sidewall surrounded by the exterior sidewall and the annular sound channel and projecting away from a bottom surface of the device housing towards the active driver. In some implementations each of the first and second passive radiators can include: a frame having an annular outer rim extending fully around an outer periphery of the frame and first and second connection ends protruding from opposing ends of the outer rim, a rigid diaphragm disposed within a central portion of the frame, a primary annular suspension coupling the diaphragm to the annular outer rim of the frame in a manner that allows the diaphragm to move within the frame, a radiator mass element, and a secondary suspension coupling the radiator mass element to the frame in a manner that allows the radiator mass to move within the frame.

An electronic speaker according to some embodiments can include an axisymmetric device housing defining an interior cavity and a conical recess at a bottom portion of the device housing where the device housing includes: (i) an outer sidewall extending around the interior cavity between a top surface and a bottom surface of the device housing defining an aperture at the top surface, and (ii) a centrally located conical sidewall surrounded by the outer sidewall and projecting upwards from the bottom surface of the device housing to a distal tip spaced apart from the top surface to define the conical recess. The electronic speaker can further include a touch responsive input device disposed within the aperture at the top surface of the device housing; first and second sound channels formed at opposing locations along the outer sidewall, each of the first and second sound channels comprising a plurality of openings formed through the outer sidewall; a passive radiator array comprising first and second passive radiators disposed within the interior cavity, spaced apart from each other in an opposing relationship and aligned to project sound through the first and second sound channels; an active driver disposed in the device housing and configured to generate sound in response to an electrical signal, the active driver comprising a driver housing disposed at least partially between the first and second passive radiators, a magnet disposed within the driver housing, a voice coil and a diaphragm spaced apart from and facing downwards towards the distal tip of the conical surface; an annular sound channel disposed along the bottom portion of the device housing surrounding the conical surface; and a foot assembly partially disposed within the conical recess and coupled to the device housing, the foot assembly comprising a planar foot operable to support the electronic speaker and a suspension system operable to dampen vibrations generated by the active driver before the vibrations are transmitted to the planar foot.

According to still additional embodiments, an electronic speaker can include: a device housing that defines an interior housing cavity; an audio driver disposed within the interior housing cavity; and a foot assembly coupled to the device housing and operable to support the electronic speaker. The foot assembly can include: a foot assembly sidewall having an outer sidewall perimeter extending outwardly away from a central neck; a planar foot having an outer foot perimeter proximate the outer sidewall perimeter where an upper surface of the planar foot cooperates with an interior surface of the foot assembly sidewall to create an internal cavity within the foot assembly; a suspension system disposed within the foot assembly internal cavity and coupling the planar foot to the foot assembly sidewall. The suspension system can include: an isolator plate disposed within the internal cavity of the foot assembly and mechanically coupled to the planar foot where the isolator plate includes a channel projecting perpendicularly away from the planar foot towards the device housing; an isolator stop fitted within the channel and having an aperture formed through the isolator stop aligned with a length of the channel; and an isolator fastener coupled to the foot assembly sidewall and disposed within the channel. The isolator fastener can extend through the isolator aperture formed through the isolator stop and can be operable to allow the foot assembly sidewall to translate with respect to the planar foot.

In various implementations, the electronic speaker can include one or more of the following features. The device housing can further define an exterior recess at a bottom surface of the device housing and the foot assembly can be disposed at least partially within the exterior recess. The isolator plate can include a plurality of channels and the suspension system can include a respective plurality of isolator stops and a respective plurality of isolator fasteners and each channel in the plurality of channels can have one isolator stop from the plurality of isolator stops fitted within the channel and one isolator fastener from the plurality of isolator fasteners disposed within the channel and extending through the aperture formed through its respective isolator stop. The foot assembly sidewall can include a plurality of fastener holes and each isolator fastener can be coupled to the foot assembly sidewall through one of the plurality of fastener holes. A vibration damper comprising a low durometer compressible material can be included in the speaker and disposed directly between the planar foot and the foot assembly sidewall. The vibration damper can include an annular body disposed proximate the outer foot perimeter surrounding the suspension system. The vibration damper can further include a plurality of teeth spaced radially apart from each other along the annular body and the plurality of teeth can extend away from the annular body toward the planar foot.

According to some embodiments, an electronic speaker is disclosed that includes: a device housing defining an interior housing cavity; an audio driver disposed within the interior housing cavity; and a foot assembly coupled to the device housing and operable to support the electronic speaker. The foot assembly can include: an anchor having a neck and a sidewall surrounding and extending radially away from the neck to an annular edge; a planar foot having an outer perimeter proximate the annular edge of the anchor and an annular channel inset from the outer perimeter and within a circumference of the anchor sidewall, where an upper surface of the planar foot cooperates with an interior surface of the anchor to create an internal cavity within the foot assembly; and a suspension system disposed within the foot assembly internal cavity and coupling the planar foot to the anchor. The suspension system can include: an isolator plate disposed within the internal cavity of the suspension system and mechanically coupled to the planar foot, the isolator plate comprising a plurality of channels projecting perpendicularly away from the planar foot towards the device housing; a plurality of isolator stops, each isolator stop fitted within one of the plurality of channels and having an aperture formed through the isolator stop aligned with a length of its respective channel; a plurality of isolator fasteners coupled to the anchor where each isolator fastener can be disposed within one of the plurality of channels and can extend through the isolator stop aperture of its corresponding channel allowing the anchor to translate with respect to the planar foot; and an annular isolator comprising a low durometer compressible material disposed with the annular channel between the planar foot and the anchor sidewall.

In some embodiments, a compact speaker sized to be placed on a table is provided. The compact speaker can include: a device housing that defines an interior housing cavity and an exterior conical recess at a bottom surface of the device housing; an audio driver disposed within the interior housing cavity; a foot assembly operable to support the electronic speaker on a surface of a table, where the foot assembly is disposed at least partially within the exterior conical recess and coupled to a bottom portion of the device housing. The foot assembly can include: an anchor having a central neck with an aperture formed through an upper surface of the neck, a sidewall surrounding and extending radially away from the neck to an annular edge, and a plurality of fastener openings formed along the sidewall; a fastener extending through the aperture in the neck and coupling the anchor to the device housing; a planar foot spaced apart from the anchor in an opposing relationship, the planar foot having an outer perimeter proximate the annular edge and an annular channel inset from the outer perimeter and within a circumference of the anchor sidewall, wherein an upper surface of the planar foot cooperates with an interior surface of the anchor to create an internal cavity within the foot assembly; and a suspension system disposed within the foot assembly internal cavity and coupling the planar foot to the anchor. The suspension system can be operable to dampen vibrations generated by the audio driver and can include: an isolator plate coupled to the planar foot and disposed within the internal cavity of the suspension system between the planar foot and the anchor, the isolator plate can include a planar surface spaced apart from the planar foot and a plurality of channels projecting perpendicularly away from the planar surface towards the device housing, where each of the plurality of channels can include an inner perimeter surface extending from the planar surface to a terminating surface and an aperture formed through the terminating surface; a plurality of isolator stops, where each isolator stop can be fitted within one of the plurality of channels and have an aperture formed through the isolator stop aligned with the channel aperture; a plurality of isolator fasteners where each isolator fastener can be disposed within one of the plurality of channels and can extend through the isolator stop aperture and channel aperture of its corresponding channel into one of the fastener openings formed in the anchor sidewall to mechanically attach the isolator fastener to the sidewall, and where each isolator fastener is operable to translate within its respective channel; and an annular isolator comprising a low durometer compressible material disposed with the annular channel at the upper surface of the planar foot and the sidewall of the anchor.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use the same reference numbers, the elements are generally either identical or at least similar in function or purpose.

BRIEF DESCRIPTION OF THE DRAWINGS

The disclosure will be readily understood by the following detailed description in conjunction with the accompanying drawings, wherein like reference numerals designate like structural elements and in which.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessary obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Figure 1:
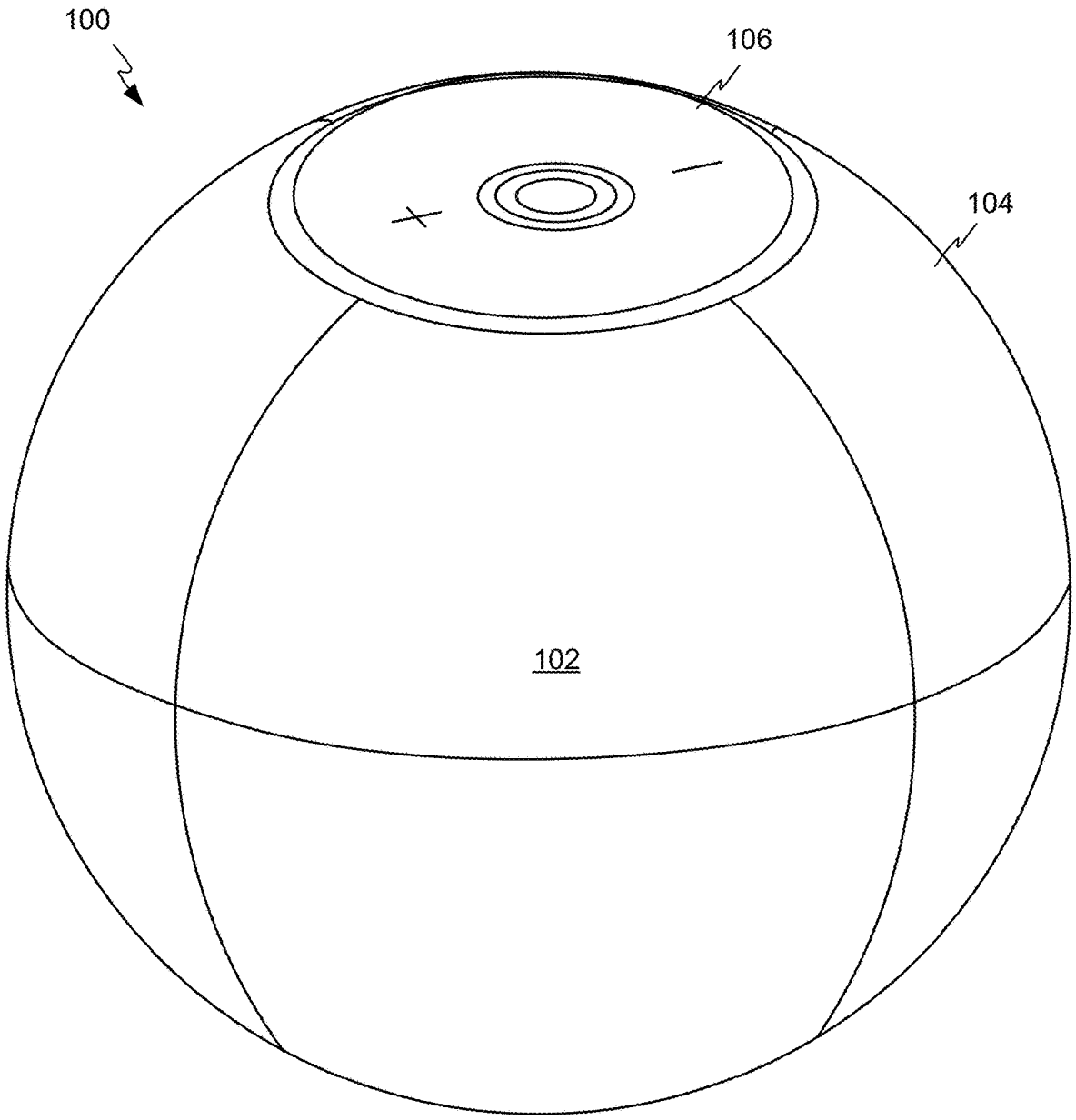
FIG. 1 is a simplified perspective view of a smart speaker according to some embodiments.

FIG. 1 illustrates a simplified perspective view of a compact smart speaker 100 according to some embodiments. Compact smart speaker 100 can include a body 102 having a continuous, aesthetically pleasing exterior surface with a symmetrical and generally spherical shape. For example, body 102 can have an outer surface in which the points along given horizontal cross-sections through body 102 are equidistance from a central axis extending through the body perpendicular to the cross-sections.

Body 102 can include one or more enclosure portions (not shown in FIG. 1) coupled together to define the shape and appearance of compact smart speaker 100. In some embodiments an acoustic fabric 104 can cover body 102 providing a consistent and aesthetically pleasing exterior finish and surface while concealing various audio ports and other components of smart speaker 100. Acoustic fabric 104 can be a woven mesh configuration that can have minimal impact on the volume or audio quality of any audio playback exiting the compact smart speaker. For example, audio waves exiting the compact smart speaker 100 can pass through acoustic fabric 104 without any interference. In some embodiments, acoustic fabric 104 can have a pattern specifically chosen and designed to conceal components or features position beneath acoustic fabric 104.

An upper portion of compact smart speaker 100 can include a user interface 106 which can allow a user to adjust settings such as track selection and speaker volume changes for compact smart speaker 100. In some embodiments, user interface 102 can be a touch sensitive surface or the like. User interface 102 can also include one or more light sources (not shown in FIG. 1) that illuminate various regions of user interface 102 to help a user interact with user interface 102.

Smart Speaker Housing and Overall Architecture

Figure 2A:
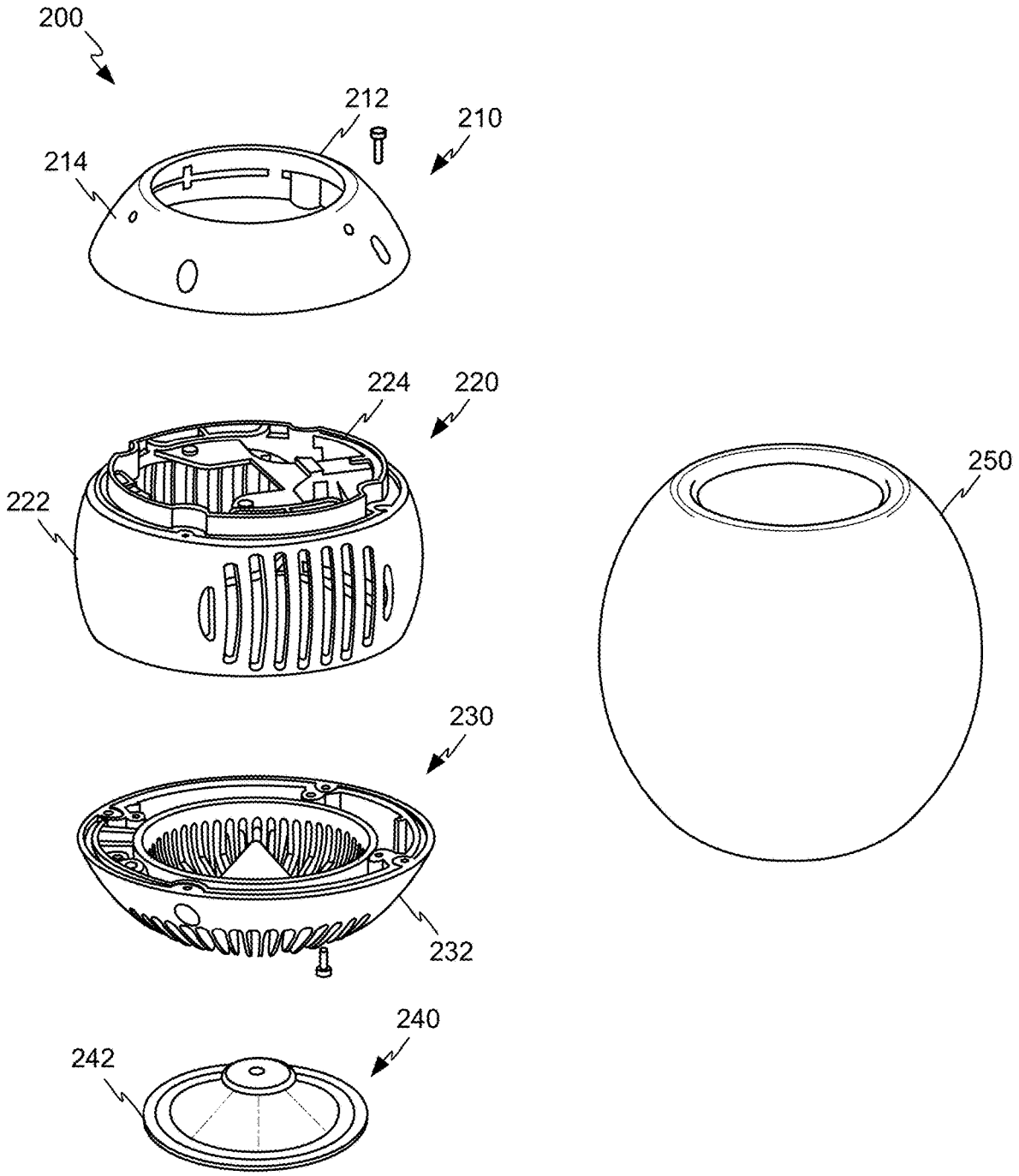
FIG. 2A is an exploded view of various components housed inside a smart speaker according to some embodiments.

FIG. 2A is a simplified exploded view of a housing 200 for a smart speaker according to some embodiments. Housing 200 can be an implementation of body 102 discussed in FIG. 1. As shown in FIG. 2A, housing 200 includes three primary components: an upper housing 210, a middle housing 220 and a lower housing 230. Also shown in FIG. 2A is a foot assembly 240 that can be coupled to lower housing 230 and an acoustic fabric material 250 that can be representative of fabric 104 and can be wrapped around housing 200 to provide a consistent and aesthetically pleasing exterior finish and surface of a smart speaker that includes housing 200.

Housing 200 can define a symmetrical and generally spherical shape of a smart speaker by stacking the three housing enclosure portions (upper housing 210, middle housing 220 and lower housing 230) together to define an interior cavity that can house the various components of the smart speaker as described below. For example, the upper housing 210 can include a planar top surface 212 with a conical sidewall 214 that extends both downwards and outwards from planar top surface 212. Middle housing 220 can include a curved sidewall surface 222 that extends between an upper surface 224 and lower surface (not numbered). Lower housing 230 can include a planar bottom surface (not visible in FIG. 2A) and a curved sidewall 232 that extends upwards from the planar bottom surface.

The generally spherical shape of housing 200 is formed when upper housing 210, middle housing 220 and lower housing 230 are coupled together in a stacked relationship. When stacked in this manner the curvature of sidewall surface 222 can be aligned with the curvature of sidewalls 214 and 232 to form an outer surface having a continuous curvature from planar top surface 212 to the planar bottom surface of lower housing component 230. Each of the bottom surface of upper housing 210, the top and bottom surfaces of middle housing 220, and the top surface of lower housing 230 can include features (e.g., lips, channels, tabs or the like) that enable the upper housing and lower housing portions to be properly aligned and mechanically attached to each other to form overall housing 200.

The housing enclosure portions 210, 220, 230 can be coupled together using any suitable attachment technique or mechanism. For example, in some embodiments the housing components can be joined together by one or more of the following: mechanical fasteners, such as screws, bolts, wire fasteners or the like, an adhesive glue or an adhesive tape, or by laser or ultrasonic welding or the like. In some embodiments, each housing portion is configured to fit over, around, and/or under one another while giving the appearance of a smooth and seamless junction between the connection points of each housing portion to one another. Acoustic fabric 250 can be wrapped around housing 200 to provide a consistent and aesthetically pleasing exterior finish and surface while concealing potential seams in the housing, various audio ports and other components of the smart speaker.

In some instances, the surface (e.g., the top surface of a desk or table) that a compact speaker, such as a compact smart speaker, is placed upon (sometimes referred to herein as the "supporting surface") can have an adverse effect on the sound quality of the compact speaker. Because of this, a number of previously known speaker and smart speaker designs include multiple individual feet that elevate the speaker a small distance above the surface upon which the speaker rests. The individual feet distribute the weight of the speaker to relatively small points of contact with the supporting surface. The relatively small points of contact can, over time, result in damage to the supporting surface in the form of dents, scratches or other markings. While reducing the weight of a compact speaker can reduce the likelihood and/or extent of such potential damage, high quality audio components can be heavy and using lighter or smaller components can be a trade off that sacrifices audio quality for weight.

Some embodiments of the disclosure provide a foot assembly 240 that is coupled to lower housing 230 and provides a single, substantially flat large contact area that distributes the weight of the compact speaker over the large contact area as opposed to multiple smaller contact points of individual fees as done by a number of known compact speakers. Towards this end, in some embodiments, foot assembly 240 includes a large planar foot 242 that evenly distributes the weight of a compact speaker amongst entire surface area of planar foot 242 and the support surface that the compact speaker device is placed upon. In some embodiments, foot assembly 240 can also serve as a damper to isolate and reduce the amount of vibration projected to the contact surface. Further details of an implementation example of foot assembly 240 are described below in conjunction with FIGS. 11A-11B and 12A-12D.

Figure 2B:
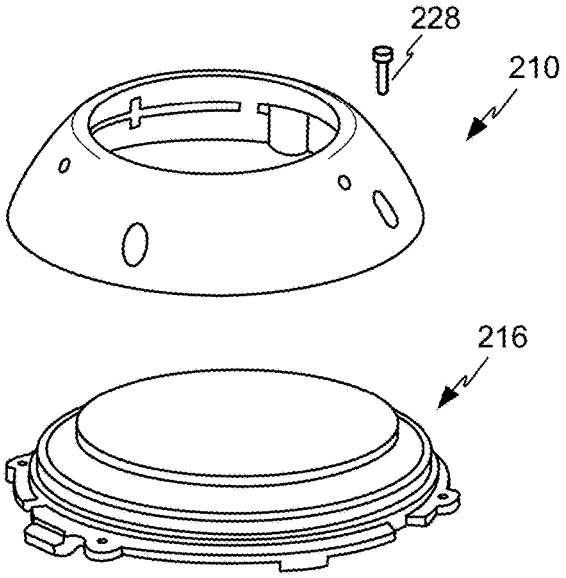
FIGS. 2B-2D are additional exploded views of various components housed inside a smart speaker according to some embodiments.
Figure 2C:
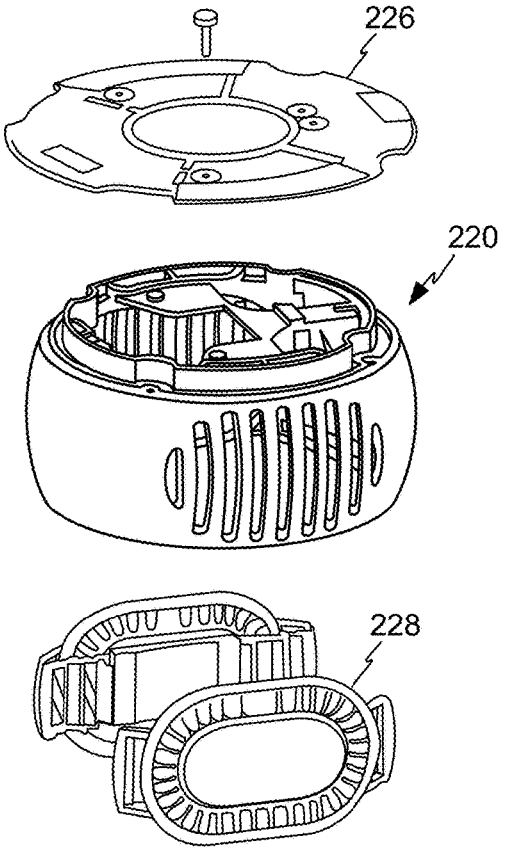
Figure 2D:
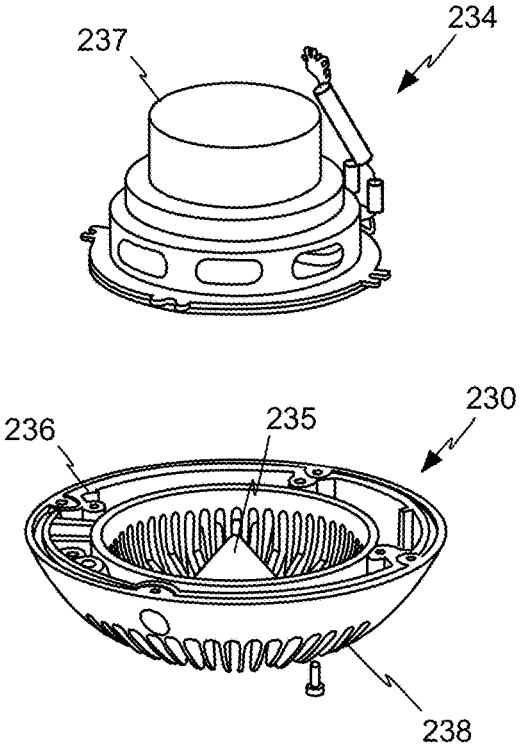

Reference is now made to FIGS. 2B-2D, which are simplified perspective views of housing portions 210, 220 and 230, respectively, along with selected components of a smart speaker that can fit within the interior cavity enclosed by the housing portions in accordance with some embodiments. As shown in FIG. 2B, a touch module assembly 216 can be coupled to upper housing 210 to allow a user to interact with and control various features of a smart speaker according to some embodiments. Touch module assembly can be, for example, a touch sensitive input device and can include a display that presents information and/or controls (e.g., volume controls) to a user. Details of an example touch module assembly in accordance with some embodiments are described in conjunctione with FIGS. 5A-5F and 6A-6B.

As shown in FIG. 2C, a main logic board 226 can be coupled to the upper surface of middle housing 220 while a passive radiator array 228 can be fitted within the portion of the housing interior cavity defined by middle housing 220. Main logic board 226 can fit within a cavity formed by upper housing portion 210 and can include multiple integrated circuits, such as a processor that controls the operations of the smart speaker, along with various components that receive, transmit, and deliver electrical signals to the components disposed inside interior cavity of compact smart speaker 200. The passive radiator array 228 can take sound generated by an active audio driver (e.g., speaker 234 discussed below) disposed within the housing 200 and create low frequency sound waves that increase the bass response of the speaker without including a voice coil or magnet assembly that is included in the active speaker. For example, the passive radiator array 228 can resonate with the air inside the enclosure and be excited by output from active audio driver 234 to move the diaphragms of the passive radiator. Thus, passive radiator array 228 can be tuned to provide more low frequency output for a compact speaker, improving the audio playback quality as compared to a speaker design that has just a single (active) audio driver.

Referring to FIG. 2D, an active audio driver 234 can be coupled to the upper surface 236 of bottom enclosure 230 and positioned such that the diaphragm of the audio driver faces downward directly towards bottom enclosure 230 and foot assembly 240. When the compact speaker is fully assembled, an upper end of the active audio driver 234, including the driver's magnets and other components, can be disposed within the portion of the interior cavity defined by middle housing 220 between portions of the passive radiator array 228. Audio driver 234 is configured to convert electrical audio signals to audio waves using a dynamic or electrodynamic driver and, in some embodiments, can include a coil of wire suspended in the air gap of a magnetic circuit to generate audio playback from an input.

Audio driver 234 can also include a diaphragm (not visible in FIG. 2D) in the shape of a cone that moves back and forth to create air pressure waves. The diaphragm can be mounted on the edge of a cone shape frame and can be forced to move in a direction perpendicular to the frame by the force on the force applied to the coil of wire by passing electrical current through it while disposed in a magnetic field created by one or more magnets. The resulting back and forth movement of the diaphragm generates pressure differentials that travel in a direction away from the diaphragm as an audio wave. Lower housing 230 can include a cone shaped projection 235 extending from its bottom surface towards audio driver 234. The air pressure waves generated by active audio driver 234 travel towards cone projection 235 and can be forced radially outward from the speaker housing through an annular sound channel 238 formed around conical projection 235 in the lower portion of lower housing 230. In some embodiments, annular sound channel 238 can include multiple slits or openings formed between adjacent ribs as shown in FIG. 2D and discussed in more detail with respect to FIGS. 10A-10D below. Audio driver 234 can further include a driver housing 237 made of electrically conductive materials where electrical signals and power can be routed to and from the driver housing by wires.

Figure 3:
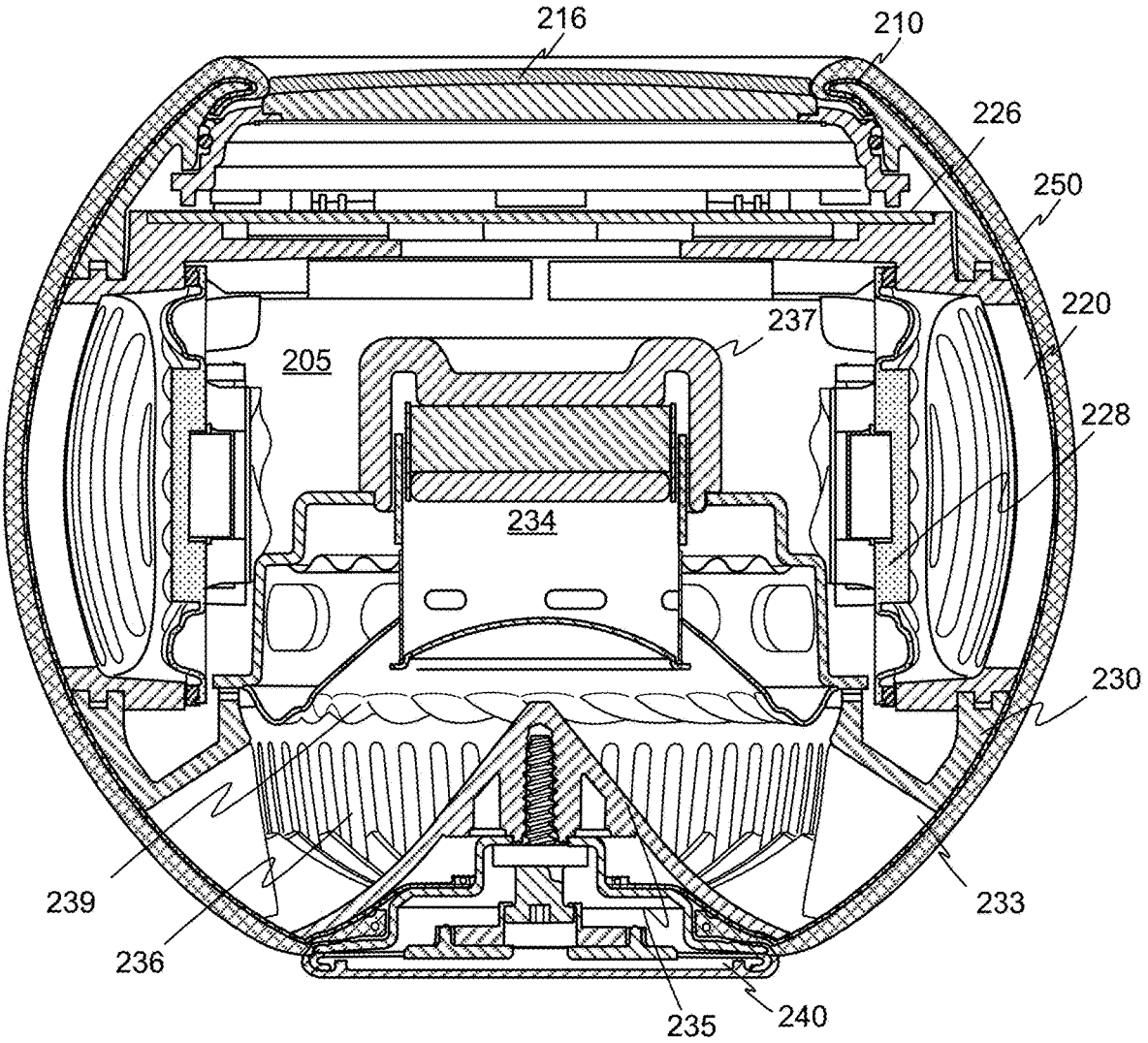
FIG. 3 is a simplified cross-sectional view of the smart speaker shown in FIGS. 2A-2D after the speaker is assembled.

FIG. 3 is a simplified cross-sectional view of an embodiment of a fully assembled smart speaker 300 according to some embodiments. Smart speaker 300 can be an implementation of smart speaker 100 and can include upper, middle and lower housing components 210, 220 and 230 discussed above with respect to FIGS. 2A-2D that combine to form a housing interior cavity 205. Speaker 300 can also include foot assembly 240 and be wrapped with an acoustic fabric 250 as discussed above. In some embodiments, acoustic seals can be situated between each of the adjacent housing components and between the upper housing component 210 and touch module assembly 216 to enable a sealed back-volume for speaker 234.

As shown in FIG. 3, touch assembly module 216 can be positioned at an upper surface of smart speaker 300 providing a touch-sensitive user-interface that enables a user to control various aspects of smart speaker 300. For example, in some embodiments the touch-sensitive user-interface allows a user to control one or more of the following features: speaker volume, advancing audio tracks, or turning the smart speaker on and off. Main logic board 226 can be positioned directly below touch assembly module 216 and can be mechanically attached to an upper portion of middle housing component 220 as shown.

Active speaker 234 can be disposed in a central location within the housing of smart speaker 300 such that it is directly above foot assembly 240 and directly below the main logic board 226. The active speaker can be mechanically attached to lower housing portion 230 with its voice coil and magnet portion extending up into the portion of interior cavity 205 mostly defined by middle housing component 220. A diaphragm 239 of the active speaker can face downward towards foot assembly 240 and direct sound waves towards conical portion 235. Sound from the speaker can be forced, by conical portion 235, radially outward through annular sound aperture 238.

One or more sensors can be included within smart speaker 300. As one specific example, a temperature sensor can be included within interior cavity 205. The temperature sensor can provide input to a processor or other controller on main logic board 226, which in turn, can cause the ambient temperature of the environment the smart speaker 300 is positioned within to be displayed, in some embodiments where the display has sufficient resolution, on a display portion of the touch module assembly and/or can use the temperature information to inform other aspects of a smart home system that are communicatively coupled to smart speaker 300 through, for example, a wired or wireless network. In some specific implementations, a temperature sensor can be positioned within the housing of speaker 234, such as in area 233 and can have a direct port through one of housing portions 210, 220 or 230 to the environment external the smart speaker.

Top Enclosure

Figure 4A:
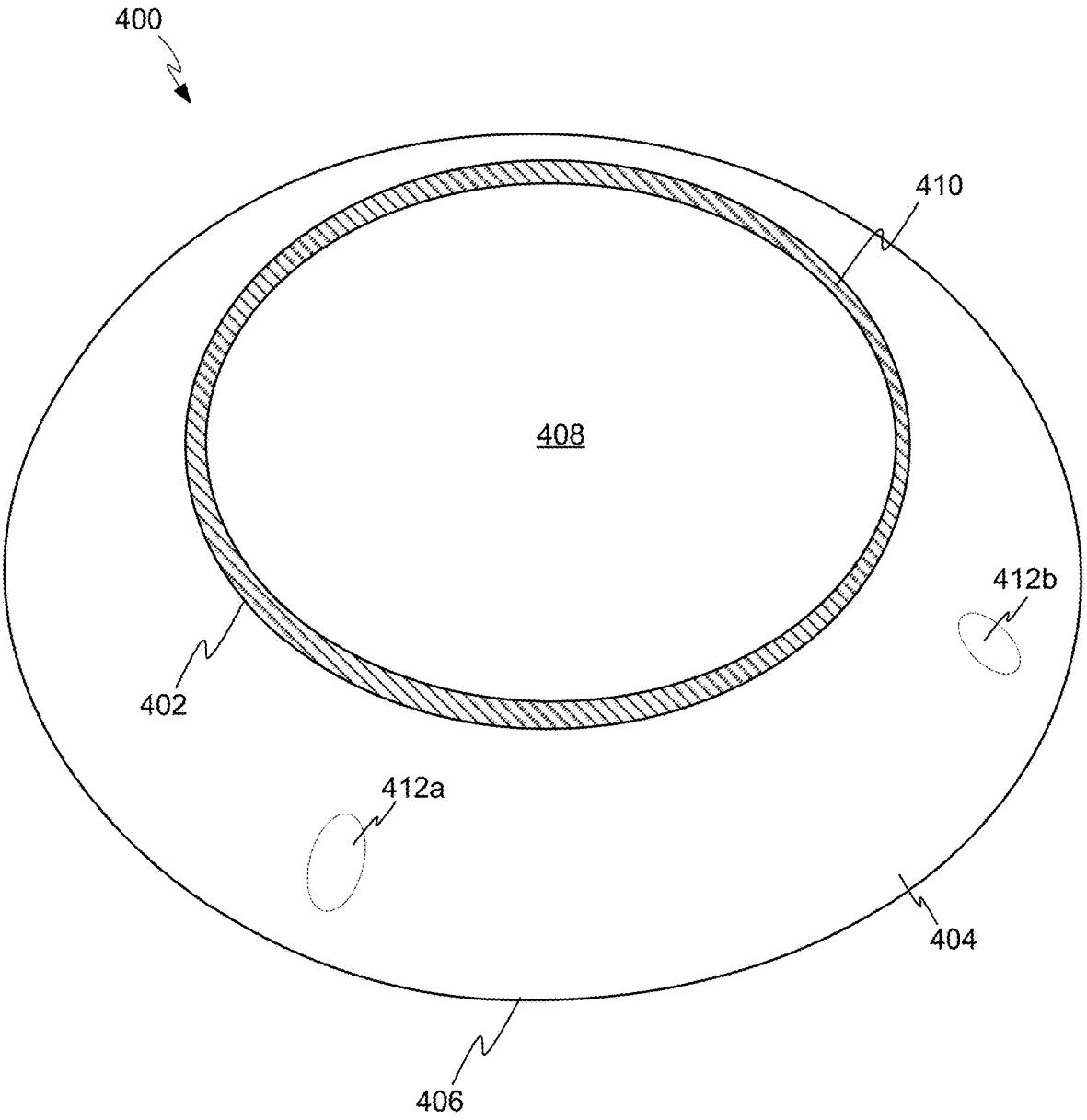
FIG. 4A is a simplified top perspective view of an embodiment of a top enclosure of a smart speaker according to some embodiments.
Figure 4B:
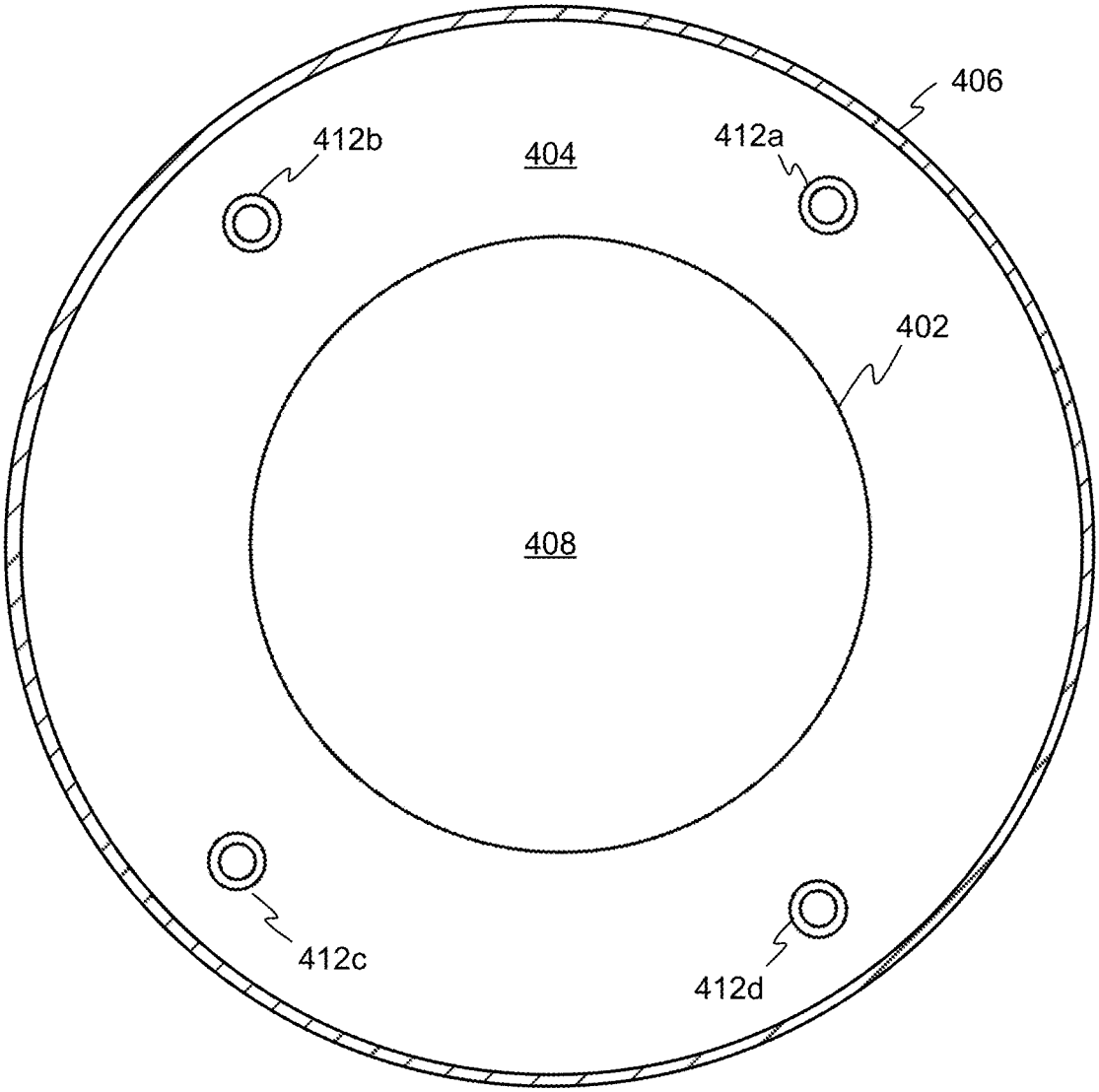
FIG. 4B is a bottom plan view of the top enclosure shown in FIG. 4A.

FIG. 4A illustrates a top perspective view of an upper housing 400 that can be representative of upper housing 210 shown in FIGS. 2A and 2B, and FIG. 4B is a bottom plan of upper housing 400. As shown in FIGS. 4A and 4B, upper housing 400 can include a sidewall 404 extends from an upper surface 402 to a bottom surface 406 of upper housing 400. The upper surface 402 can be in the form of a substantially flat rim 410 that surrounds an aperture 408. While aperture 408 can have any suitable shape, in the embodiment depicted in FIG. 4A, aperture 408 has a circular shape. Rim 410 can have a diameter that is just slightly larger than the diameter of aperture 406 and can create a narrow ledge that surrounds the aperture. In some embodiments, rim 410 can include one or more indentations, alignment features or mounting features to enable internal components to be mounted to and supported by the upper housing.

In some embodiments top enclosure 400 can be a unitary structure that is generally conical in shape and that defines an internal space or cavity which is surrounded by sidewall 404. Upper housing 400 can be made from any suitable material and in some embodiments is made from a solid and/or stiff plastic polymer material that can be molded to retain a specific shape. As non-limiting examples, the plastic polymer material can be polycarbonate or any moldable plastic material that can retain a specific shape to act as a protective structure for the internal components and to give shape to top, approximate third, portion of the compact smart speaker. As discussed herein, various electrical and other components can be housed within the internal cavity and protected by upper housing 400.

Aperture 408 can be a planar opening that allows for a touch-controlled portion of a touch module (not shown in FIG. 4A) to be accessed by a user. Sidewall 404 can radially expand outwards and downwards from upper surface 402 towards bottom surface 406 of the upper housing 400 such that the diameter of sidewall 404 increases gradually from a smallest diameter portion at upper surface 402 to a largest diameter portion at bottom surface 406. In some embodiments sidewall 404 is generally conical in shape and is in the form of a solid smooth piece of plastic polymer.

Sidewall 404 can include one or more openings, such as openings 412*a*-412*d*, positioned spaced apart along the sidewall. Each opening can extend completely through the sidewall 404 and can facilitate the attachment of one or more components to the upper housing 400. As an example, openings 412*a*-412*d* can be openings configured to receive a fastening mechanism, such as a screw 218 shown in FIG. 2B, to secure components mounted inside the internal cavity defined by sidewall 404 or to couple upper housing 400 to the middle housing.

As shown, bottom surface 406 defines the end of sidewall 404 and thus the bottom of upper enclosure 400. Bottom surface 406 can have a similar cross-sectional shape as upper surface 402, which in some embodiments can be circular. Since sidewall 404 extends radially outward from upper surface 402 to bottom surface 406, the bottom surface can also have a diameter that is larger than the diameter of upper surface 402. In some embodiments, bottom surface 406 can be configured to receive a protrusion formed on an upper surface of the middle housing component as discussed below.

User Interface

Figure 5A:
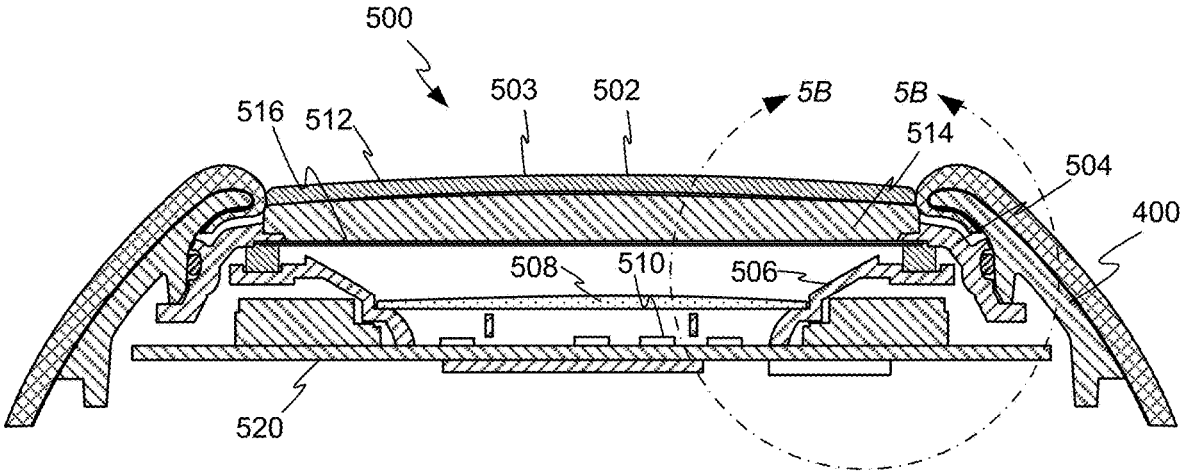
FIG. 5A is simplified cross-sectional side view of an upper portion of a compact smart speaker and a user interface according to some embodiments.
Figure 5B:
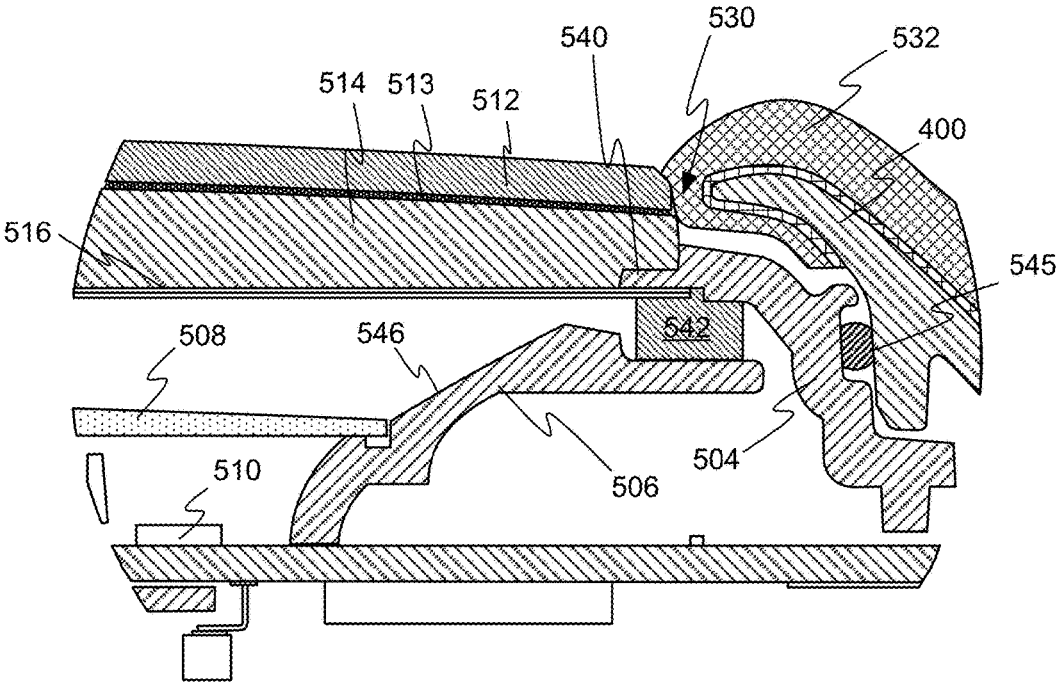
FIG. 5B is an exploded view of a portion of the compact smart speaker and user interface shown in FIG. 5A.
Figure 5C:
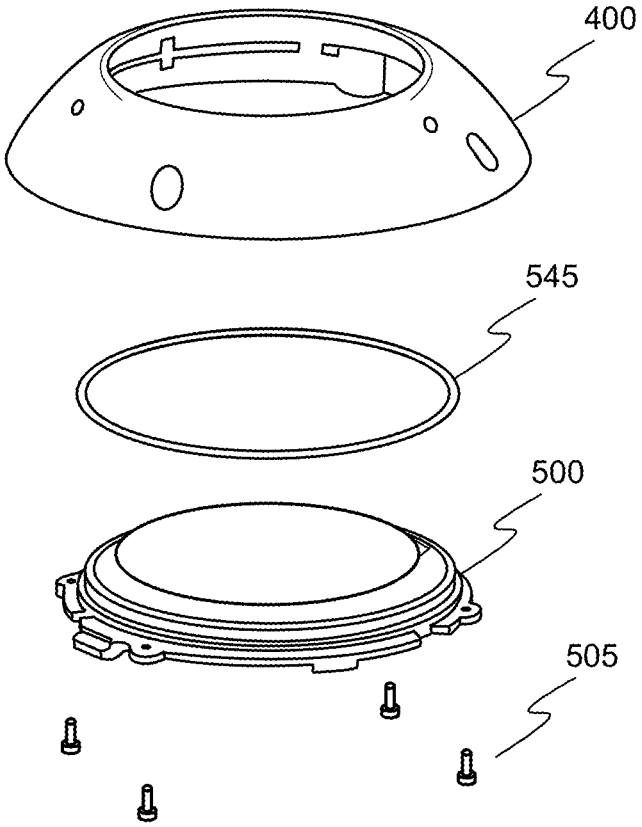
FIG. 5C is an exploded view of various components housed inside a smart speaker according to some embodiments.

FIG. 5A is a simplified cross-sectional view of a user interface module 500 fit within a portion of upper housing 400, and FIG. 5B is an expanded view of a portion of the user interface module shown in FIG. 5A. The user interface module 500 can include a touch display 502 that can be mounted to upper housing 400 by a mounting frame 504, a shroud 506 that supports a diffuser 508 and multiple light emitting diodes (LEDs) 510. In some embodiments the mounting frame can be affixed to upper housing 400 by fasteners 505, such as screws, and one or more sealing elements can be disposed between the two components to create a strong seal between the mounting frame 504 and upper housing 400 as shown in FIG. 5C. The sealing elements can include, for example, an o-ring 545 and one or more adhesive layers. The touch display 502 can display information to a user and recognize and detect the location of a user's touch on the surface to control various aspects of a smart speaker. In some embodiments, touch display 502 can be a multilayer module that includes an upper protective top cap 512 (e.g., a transparent resin layer), a transparent window 514 and a transparent touch sensor 516. An optically clear adhesive 513 can be used to adhere top cap 512 to window 514.

In some embodiments touch display 502 can include a convex exterior touch surface 503 as the upper most, outer layer of the touch display 502. For example, top cap 512 can have a convex disc shape where a top surface forms the exterior touch surface of user interface module 500. To accommodate for the spherical geometry of the compact speaker device, the top cap 512 and/or transparent window 514 can be thicker in a middle portion than at an edge portion.

In some embodiments, touch surface 503 can have a circular display area (in addition to or instead of a convex exterior surface) and user interface module 500 can include various mechanical and material layers arranged in the three-dimensional space of the user interface module 500 to achieve a desired roll-off and diffusion of lighting that illuminates the touch display 502. For example, user interface 500 can include one or more of the following features to achieve the desired illumination at touch surface 503: the LEDs 510 can be positioned beneath and arranged in a particular geometry to project light upwards towards touch surface 503 in a uniform and dispersed manner, multiple apertures can be formed at locations around and within the user interface module to control brightness distribution, optical masking can be employed along outer edges of components, various components can be coated with paint that has particular reflection and abosorbtion properties to control light reflections within the interface module, and/or the optical clear adhesive 513 can be selected to have an index of refraction that further controls light diffusion properties within the module. As an additional specific example, window 514 can be configured to absorb and recycle some of the light emitted from the LEDs 510 to create a roll off effect described further herein Touch sensor 516 can be secured to an upper portion of window 514 and the window 514 can vary in thickness in order to accommodate for the curvature of the spherical geometry of the compact smart speaker where a middle portion of the window can be thicker than an edge portion. In some embodiments, the touch sensor can be calibrated during assembly to adjust for the curvature at the exterior surface of the top cap 512 and enable a consistent user input to be achieved across the entire exterior touch surface of the touch display 502. In this manner, situations in which touch inputs are read at a different speed in the center than along a periphery of the touch sensor can be avoided. In some embodiments, window 514 can be coated with a layer of ink that further diffuses light passing through the display.

Top cap 512 can take the form of a layer of glass or transparent polymer material such as a polycarbonate material to provide a smooth surface upon which a user can comfortable make touch inputs. Top cap 512 can include a depicted pattern that includes symbols corresponding to increasing and decreasing a setting within a smart speaker, such as compact smart speaker 100. For example, in some embodiments, plus (+) and minus (−) signs can be visible on opposing sides of touch surface 503 and can be represented by separate touch zones that allow a user to raise or lower the volume or skip tracks in a song. As an example of one particular implementation for such an interface, a short press of the touch display in the area of the plus (+) symbol can be configured to increase volume while a long press of the plus (+) symbol can be configured to skip to the next track of a media playlist. Similarly, a short press of the minus (−) symbol can be configured to decrease volume while a long press of the minus (−) symbol can be configured to skip back to the previous track of a media playlist.

Touch display 502 can be supported by mounting frame 504. In some embodiments, the mounting frame 504 can include an annular flange portion 540 that supports touch display 502. A foam insert 542 can be disposed between an inner surface of the mounting frame 504 and shroud 506 enabling the shroud to be press-fit against the mounting frame. In some embodiments foam insert 542 includes two separate foam pieces disposed in an opposing relationship along a portion of the annular mounting frame as shown in FIG. 5E.

Figure 5D:
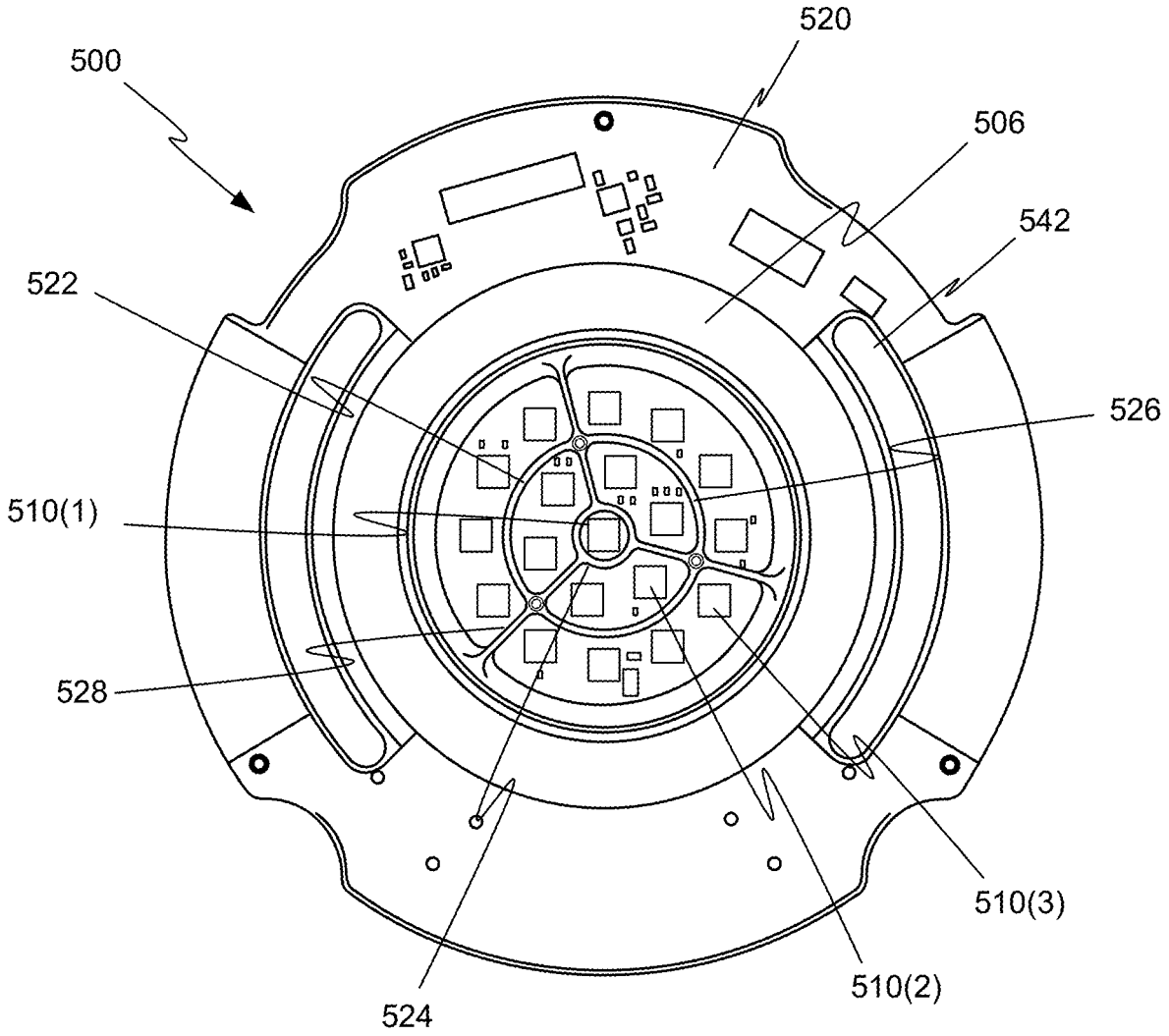
FIG. 5D is a simplified top view of portions of selected components of a user interface according to some embodiments.
Figure 5E:
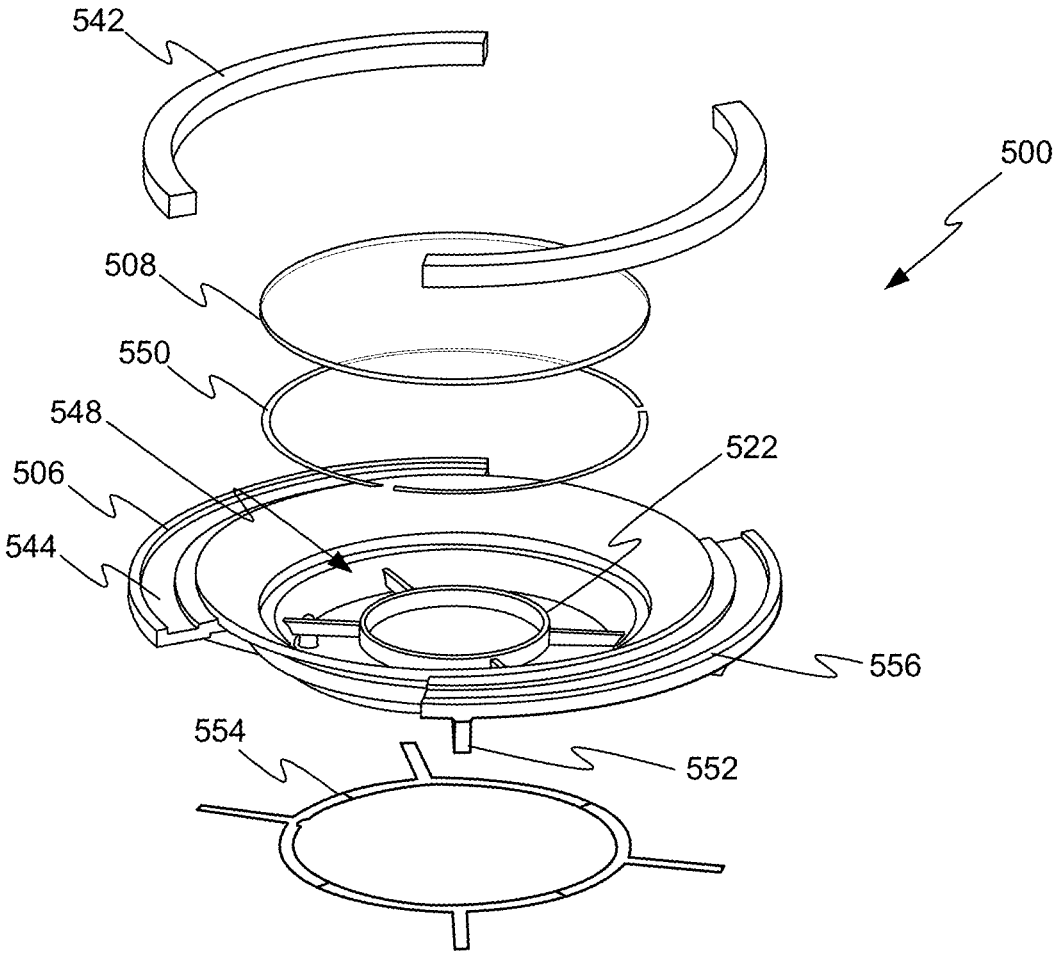
FIG. 5E is an exploded view of various components housed inside a smart speaker according to some embodiments.

As shown in FIG. 5E, shroud 506 can be a unitary structure that has a generally circular shape with a body that defines ribs as discussed below. Two outward protruding flanges 556 can be formed on opposite sides of the shroud each of which includes a channel 544 that accepts the foam inserts 542. Each foam insert 542 can be sized to provide a gap between the bottom surface of the flange portion 540 and a top surface of the shroud 506 as shown in FIG. 5B.

Mounting frame 504 can have a circular ring shape that fits within an inner perimeter of the sidewall of upper housing 400 and can be coupled to a region of the upper housing near the top aperture 402. The ring shape of mounting frame 504 enables the mounting frame to define a central space within upper housing 400 that accommodates various components of the user touch interface module 500.

Referring back to FIG. 5B, which is an exploded view of a portion of FIG. 5A, mounting frame 504 and upper housing 400 can combine to form a channel 530 that extends around an inner periphery of upper housing 400 and can receive an end portion of an acoustic fabric covering 532, which can be an implementation of acoustic fabric 250 discussed with respect to FIG. 2D. Channel 530 allows the end of the acoustic fabric to be conveniently wrapped around mounting frame 504 along channel 530 and bonded to the upper housing. In some embodiments, channel 530 can be sized to provide an interference fit between the soft acoustic fabric and the hard top cap 512 of the touch display thus ensuring there is no open cosmetic gap between the fabric and display.

A light emitting component 510 can be disposed on a control board 520 and positioned to project light towards window 514 to illuminate an upper surface of touch display 502. In some embodiments, touch display 502 provides an edge-to-edge display within the aperture 408 of upper housing 400 and the components of the user interface module 500 work together to minimize or eliminate illumination hot spots and color separation or break-up on the display while providing a uniform luminance profile and color contrast across the display. For example, in some embodiments the light emitting component 510 is a set of LEDs arranged in a ring-like pattern that aligns with the circular shape of aperture 408 and thus the circular shape of touch display 502.

Reference is made to FIG. 5D, which is a simplified plan view of a portion of user interface module 500 that depicts the layout of LEDs as light emitting component 510 in accordance with some embodiments. As shown in FIG. 5D, light emitting component 510 can include a central LED 510(1) surrounded by a first, inner ring of five LEDs 510(2) and a second, outer ring 510(3) of 12 LEDs. Each of the LEDs in LED groupings 510(1), 510(2) and 510(3) can be mounted on control board 520.

Shroud 506 can include an inner baffle 522 that surrounds various groupings of the LEDs to constrain the angular spread of illumination from each LED. As shown, the inner baffle 522 includes an inner ring 524 that surrounds central LED 510(1), an outer ring 526 that separates inner LED ring 510(2) from outer LED ring 510(3), and three separate ribs 528 that connect the inner and outer rings 524, 526 to the main body portion of shroud 506 and that also separate groups of the LEDs in each of the inner and outer LED rings from other LEDs in the same rings. The separate groups of LEDs can be individually controlled to create an optical roll off where light emitted by the LEDs are concentrated as a central location and the light emitted dissipates as it reaches the outer edges of touch display 502.

Figure 5F:
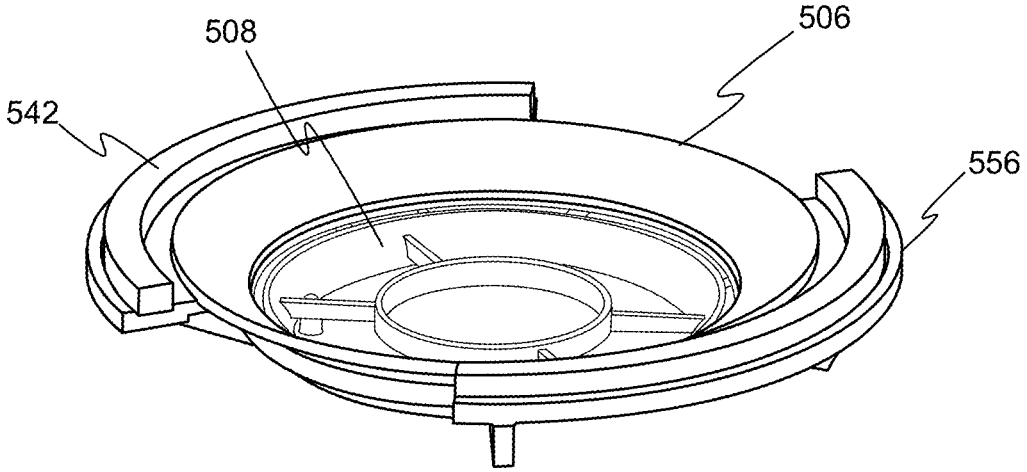
FIG. 5F is a simplified perspective view of the components shown in FIG. 5E in an assembled state.

FIG. 5E provides a simplified exploded perspective view of a portion of user interface module 500 including the shroud 506 and its baffle 522 and FIG. 5F is a simplified perspective view of the portion of the user interface module 500 shown in FIG. 5E in an assembled form. As shown in FIGS. 5E and 5F, shroud 506 can further include a bottom surface and feet 552 that can facilitate attachment of the shroud to control board 520 by a pressure sensitive adhesive layer 554 that lines the bottom surface and feet 552 of the shroud. The shroud 506 can be disposed above the LEDs 510(1)-510(3) and can support diffuser 508 within a circular recess 548 that positions the diffuser in the illumination path of the LEDs below touch display 502 and spaced apart from both the LEDs and display. An adhesive or glue layer 550 can secure the diffuser within recess 548. Diffuser 508 can be made from a semi-transparent material that is selected to blend the light generated by LEDs 510(1)-510(3) to reduce hot spots and other undesirable artifacts spreading the light from LEDs 510(1)-510(3) evenly across the touch display 502.

In some embodiments, diffuser 508 can take the form of a single piece of glass that spreads the light from each of LEDs 510(1)-510(3). In other embodiments, diffuser 508 can include multiple discrete lenses that aid in the blending and spreading of the light emitted by the LEDs. In some embodiments, diffuser 508 can be formed from a clear polycarbonate resin that is doped with particles having a different index of refraction than the clear polycarbonate resin. For example, the polycarbonate resin can be doped with titanium oxide particles that give a white appearance to the diffuser 508 and help further diffuse the light passing through the diffuser 508. Diffuser 508 can also have a dome-shaped upper surface in some embodiments to help the diffuser 508 achieve the same curvature as the outer surface of touch display 502. In various embodiments shroud 506 can be made from a relatively dark, light absorbing plastic and the curvature of an upper surface 546 of shroud 506 can help further reduce hot spots by restricting the spread of light between the LEDs and touch display and absorbing reflected light.

Each of the LEDs 510(1)-510(3) can be operable to emit multiple colors of light, for example red, green and blue light. The LEDs can also be configured to cooperatively generate various designs associated with a touch interface assembly 500. The color each of the LEDs emits can be associated with a touch interface region within touch display 502. Light emitted by the LEDs can be modulated in accordance with touch inputs processed by a touch sensor 516 of the touch display 502. Touch sensor 516 can be designed to allow light to pass through the sensor into window 514 and protective resin layer 512 while also receiving a user's input through a series of sensor regions defined on a surface of the touch sensor as described further herein. In one particular embodiment, two volume control regions can be formed by touch display 502 in the shape of plus and minus symbols (e.g., as shown in FIG. 1) associated with increasing and decreasing, respectively, the volume of the smart speaker. In some embodiments, light emitted by LEDs 510 and diffused by the aforementioned diffusive elements can cooperatively generate a mix of light where the brightness is concentrated at a desired location within top cap 512.

Touch Display

Figure 6A:
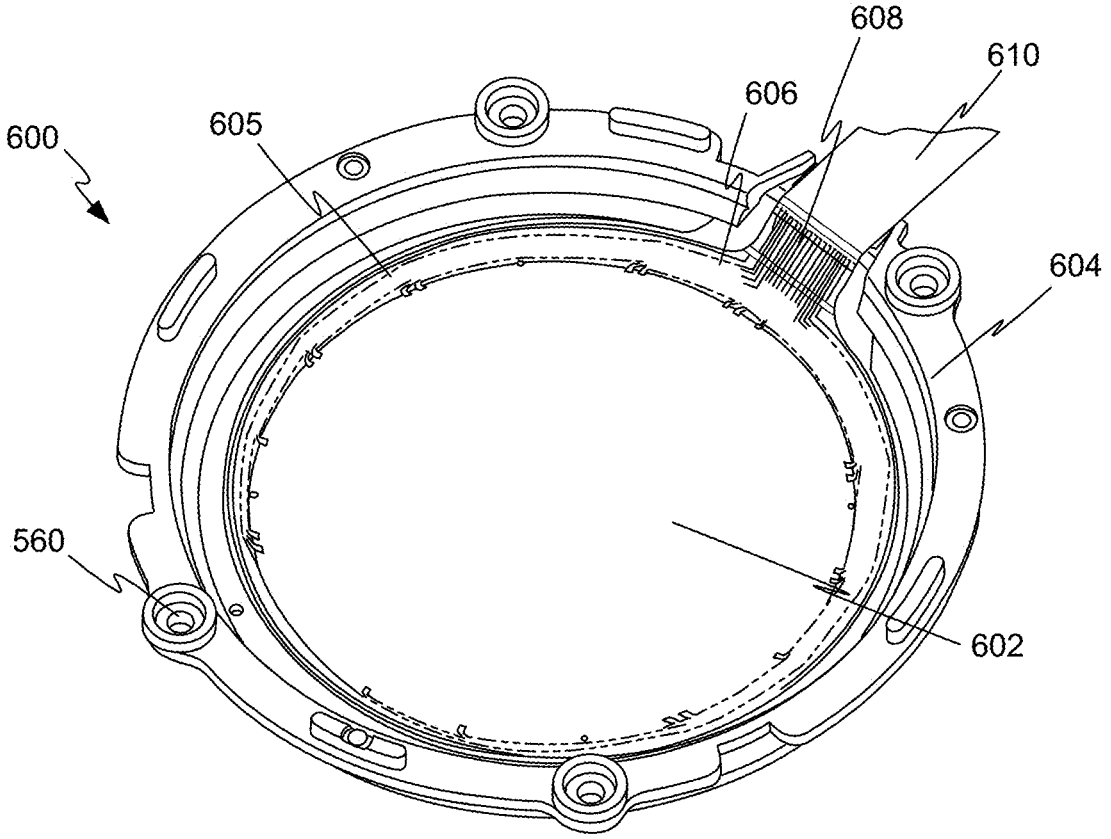
FIG. 6A is a bottom perspective view of a touch sensor component according to some embodiments.

FIG. 6A is a simplified bottom perspective view of a touch sensor assembly 600 according to some embodiments. Touch sensor assembly 600 can include a touch sensor 602 disposed within and coupled to a touch frame 604. Touch sensors 602 can be an implementation of touch sensor 516 discussed above with respect to FIGS. 5A-5D and touch frame 604 can be, for example, mounting frame 504 also discussed with respect to FIGS. 5A-5D. Touch frame 604 can include a plurality of apertures 615 that enable the frame, and thus the touch sensor 602, to be secured to other components of a smart speaker, such as circuit board 520, with a fastener. Since touch sensor assembly 600 can be disposed in the optical path between illuminating source 510 and touch display 502, touch sensor 602 can be positioned directly under the touch display that is generally transparent to light. Electrical traces 605 for the touch sensor can be routed around an outer perimeter of the sensor to a flex circuit 610, which can electrically coupled touch sensor 600 to control circuitry (e.g., on the main logic board) and other components in the smart speaker by the flex circuit 610.

Figure 6B:
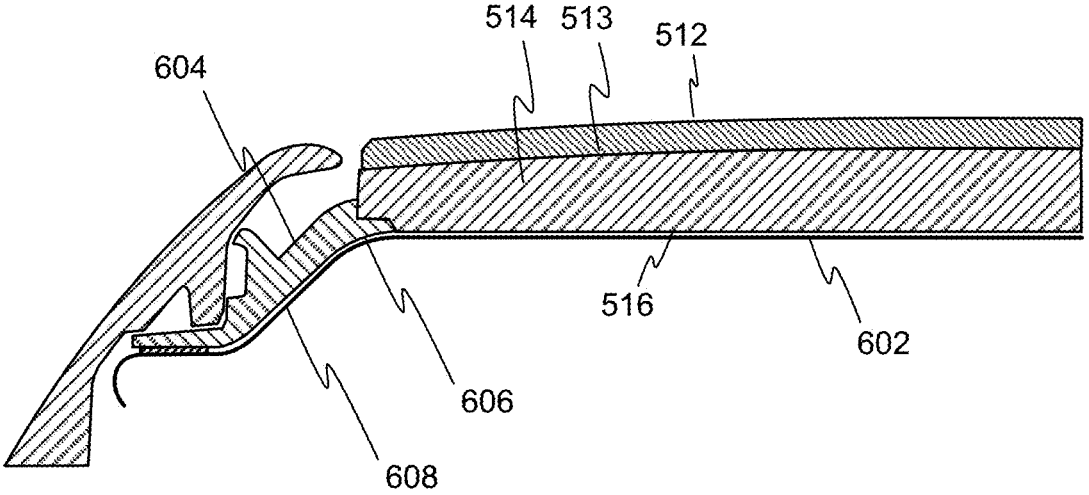
FIG. 6B is a simplified cross-sectional view of a portion of a user interface according to some embodiments.

Electrical traces 605 can be bonded to flex circuit 610 by any appropriate means and in some embodiments are coupled to the flex circuit 610 by an anisotropic conductive film (ACF) adhesive 608, which is a heat-bondable electrically conductive adhesive film that includes a thermosetting epoxy/acrylate adhesive matrix randomly loaded with conductive particles. The particles allow interconnection of circuit lines through the adhesive thickness after bonding, but are spaced far enough apart for the ACF adhesive to be electrically insulating in the plane of the adhesive. In some embodiments the touch sensor includes an outer region 606, adjacent to where electrical traces 605 are bonded to flex circuit 610, that has a high curvature bend. Region 606 creates design space for ACF adhesive 608 and helps prevent display artifacts. surrounding sensing region 602. Electrical traces 605 can be made from a silver paste into silver nanowires that can be laminated into a desired geometry allowing the traces to be bent with the the portion of touch sensor 600 in region 606 to enable the high curvature bend. FIG. 6B, which is a simplified cross-sectional view of a portion of touch sensor 600 coupled to mounting frame 504, further illustrates how touch sensor 600 can be laminated into a non-flat geometry. Specifically, high curvature area 606 is shown at an outer edge of touch sensor 600.

Figure 6C:
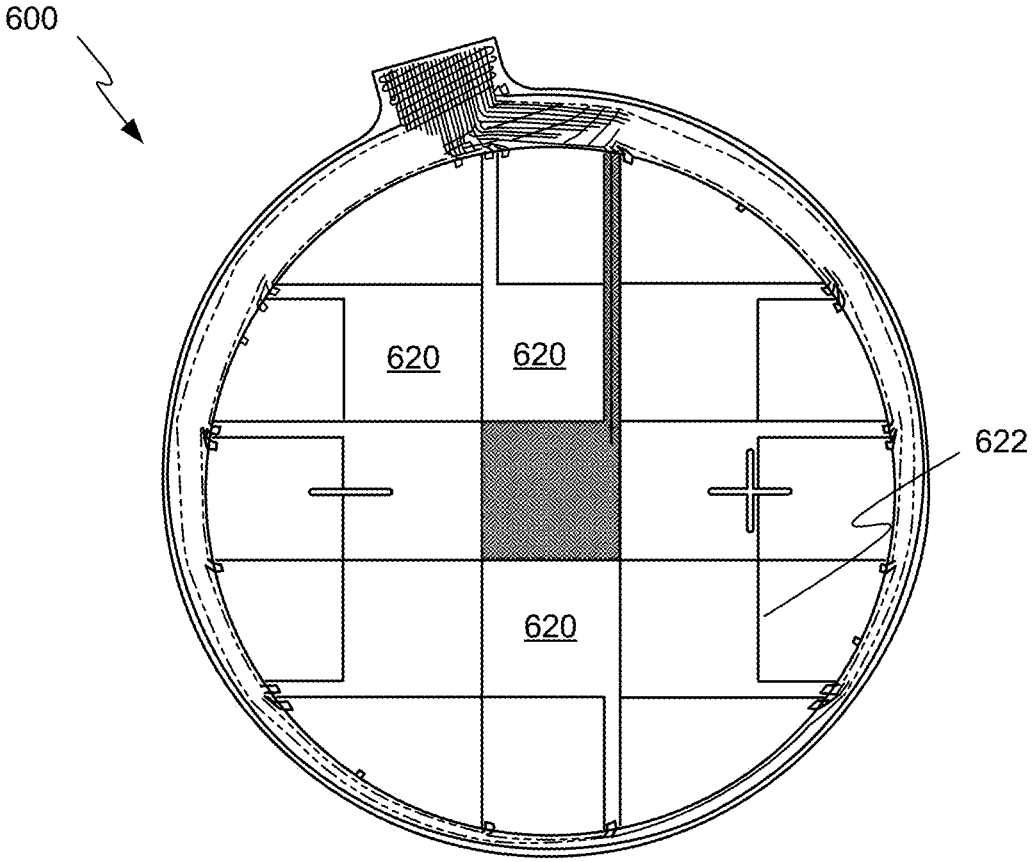
FIG. 6C is a simplified illustration of a plurality of capacitive touch pixels formed on the touch sensor of FIG. 6A in accordance with some embodiments.

Referring to FIG. 6C, the touch sensor 600 can include multiple different sized and shaped capacitive touch receptive pixels 620. In some embodiments, the touch sensing portion 602 includes a silver paste layer that has silver nano-wire printed onto the surface in a particular pattern of traces 622 to allow for the separation and designation of each individual pixel 620. The silver nano-wire defines the shape and size of each pixel 620 and forms the boarder of each pixel. As shown, some pixels 620 are larger in area than others and some pixels 620 can have a similar or different shape than others. Each set of silver nano-wires 622 is routed to an outer periphery of the touch sensing portion 602 from where the nanowires are routed into flexible cable 610 as described above.

Middle Enclosure

Figure 7:
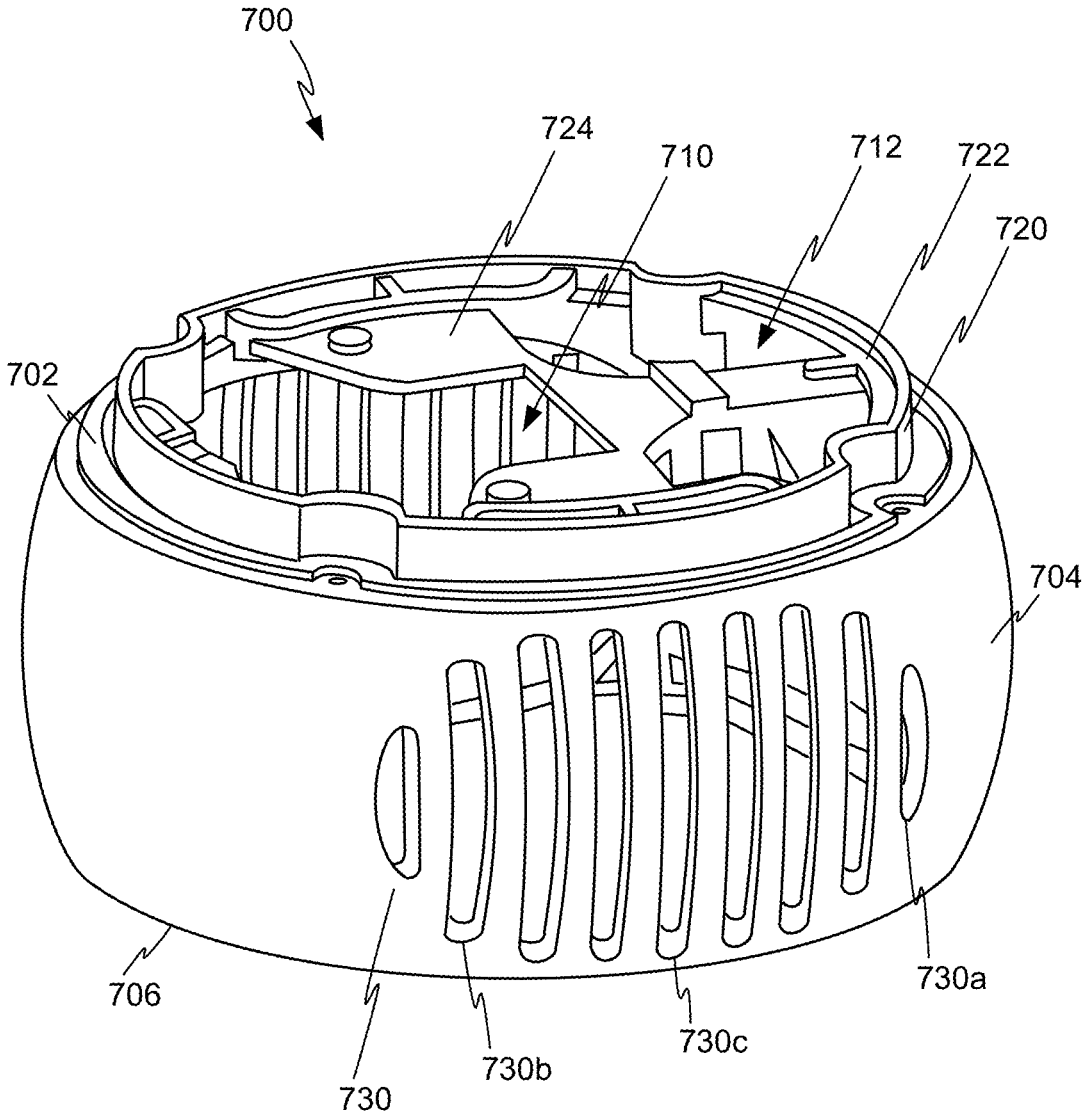
FIG. 7 is a perspective view of a middle housing portion of a smart speaker according to some embodiments.

FIG. 7 is a simplified perspective view of a middle housing 700 according to some embodiments. Middle housing 700 can be representative of middle housing 220 discussed above with respect to FIGS. 2A-2D. Middle housing 700 can include a sidewall 704 that extends between upper and lower surfaces, 702 and 706, respectively. Sidewall 704 defines an interior cavity 710 extending from a top aperture 712 to a bottom aperture (not labeled). Middle housing 700 can be a unitary structure made of a solid and stiff plastic polymer or other appropriate material. Middle housing 700 can be made of the same or different material (e.g., plastic polymer) than the upper housing 500 and lower housing 1000 (discussed below) In some embodiments, middle housing (and each of the upper and lower housing components) has a smooth finish at its exterior surfaces.

Middle housing 700 can include a lip 720 that protrudes from upper surface 702 and is inset a small distance from the outer periphery of sidewall 704. Lip 720 can define the shape and size of top aperture 712 and can be operable to engage with a corresponding feature on upper housing 500 to secure the two housing components together. When middle housing 500 and upper housing 300 are joined together, top aperture 712 aligns with a bottom aperture through upper housing 500.

Lip 720 can include a ledge 722 around portions of the inner periphery of the lip that can accept a logic board, such as main logic board 226 shown in FIG. 2C or control board 520 shown in FIG. 5A. A support bridge 724 can span portions of top aperture 710 providing additional support for the main logic board or other components. The support bridge 724 can include one or more arms (not labeled) that are provide ledges on which the main logic board can be mounted and/or secured. As shown in FIG. 7, support bridge 724 is a "Y" shaped structure that connects to three different locations along an inner perimeter of the lip 720. In some embodiments, middle housing 700 (including lip 720, support bridge 724 and other elements of the middle housing) is a single unitary structure formed by an injection molding process. In other embodiments, however, various components of middle housing 700, such as support bridge 724, can be formed separately and joined together by mechanical or chemical means (or both) previously described.

In some embodiments, sidewall 704 can include a sound channel 730 that can be, for example, a series of geometrically designed slots formed at various points around the perimeter of the body that are aligned with the passive radiator array 228 discussed herein. For example, sound channel 730 can be formed at two, opposing locations on sidewall 704 as shown in FIG. 7. Sound channel 730 allows for improved audio quality by enabling audio output through sidewall 704 in a manner as to radially distribute sound 360 degrees evenly around the compact smart speaker while providing a surface and structure for an outer acoustic fabric layer, such as acoustic fabric 750, to be attached to middle housing 700. In the embodiment shown in FIG. 7, various ones of the slots in sound channel 730 can be sized differently to maximize audio performance. For example, as shown, the series of slots in sound channel 730 can be formed in such a manner such that the slots combine to form a general oval shape as the slots 730*a* at opposing ends of the oval are shorter than the adjacent slots 730*b*, which in turn, are shorter than slots 730*c* in the middle portion of the oval-shaped sound channel. While the slots in sound channel 730 depicted in FIG. 7 are generally elongated slits or lines, embodiments of the disclosure are not limited to any particular shape slots, and in some embodiments, sound channel 730 can include slots or cutouts that are circular, rectangular, hexagonal or the like with rounded or with angled corners.

Heat Spreader

Figure 8:
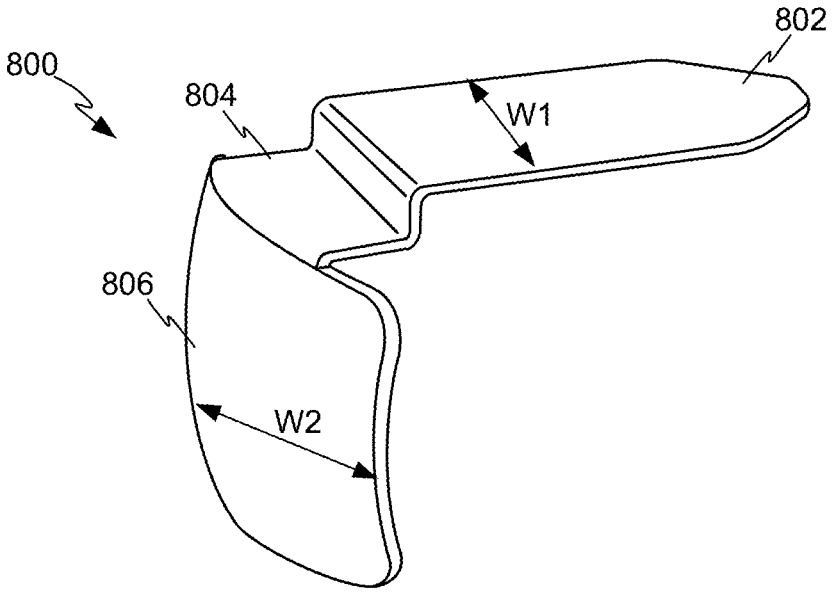
FIG. 8 is a simplified perspective view of a heat spreader according to some embodiments.

FIG. 8 is a simplified perspective view of a heat spreader 800 that can be housed within cavity 710 defined by middle enclosure 700. Heat spreader 800 can be a unitary structure with a specifically designed geometry designed to conduct any heat generated by components inside the smart speaker away from other components that can be heat sensitive. Heat spreader 800 can vary in size and shape depending on the amount of heat that needs to be exchanged in a given embodiment. Generally, the surface area of heat spreader 800 determines the amount of heat conduction. A larger surface area will increase the effectiveness of heat exchange while a smaller surface area will allow for a more compact and lighter weight heat spreader. For example, a geometric shape with a large surface area will be more effective at conducting heat away from an area than a geometric shape of a smaller surface area. In addition, the direction of exchange can also be controlled by the shape of a heat spreader. Heat spreader 800 can be made from a high thermal conductive material that can retain a specific shape, such as copper or other appropriate metals or thermally conductive materials, such as aluminum, diamond, silicon carbide or a mixture of one or more different thermal conductive materials.

In the embodiment depicted in FIG. 8, heat spreader 800 includes a horizontal surface 802 extending to a step transition portion 804. A sidewall 806 extends downwardly away from step 804. Horizontal surface 802 can be planar and positioned to redirect and radiate heat generated from inside the interior cavity away from upper housing 500 to protect heat sensitive components, such as a main logic board 520. In some embodiments, horizontal surface 802 can be coupled directly to a spacer (not shown) positioned under the main logic board 520 to ensure optimal operating efficiency of the main logic board and its components due to any potential interference from other components within the smart speaker. For instance, the spacer can acts as an EMI shield to shield the magnets of an audio driver away from the magnetic sensitive components on a main logic board 520. In essence, the spacer can be form from a gasket material that can block EMI field generated from another adjacent component. In some embodiments, heat spreader 800 can also be directly coupled to thermally sensitive components on the main logic board by a thermally conductive adhesive or the like.

Heat spreader 800 can also redirect soundwaves away from the top portion of middle housing 700 downward towards a bottom opening of the middle housing. In some embodiments, main logic board 520 can include vibration sensitive components mounted thereon and heat spreader 800 can serve as a barrier layer that blocks and redirects soundwaves away from main logic board 520 and thus away from the vibration sensitive components. For instance, horizontal surface 802 of heat spreader 800 can be sufficiently large in surface area to cover most or all of top aperture 712 of middle enclosure 700 to redirect both soundwaves and heat away from main logic board 520. In other instances, the combination of horizontal surface 802 and support bridge 724 can cover the entirety of top aperture 712 of middle housing 700 to redirect soundwaves away from the main logic board.

As shown in FIG. 8, step portion 804 extends into a vertical surface of sidewall 806 that is generally perpendicular to horizontal surface 802. Sidewall 806 can be disposed adjacent to sidewall 704 of middle enclosure 700 such that the sidewall 806 is parallel to a portion of sidewall 704 that does not include slots 730. In some embodiments sidewall 806 is a planar surface but in other embodiments sidewall 806 can have a curvature that, for example, matches that of sidewall 704.

Passive Radiator Array

In some embodiments, heat spreader 800 can be disposed in a portion of interior cavity 712 between opposing radiators of a passive radiator array. The passive radiator array can take sound generated by an active driver (e.g., speaker 234 shown in FIG. 2D) disposed within the housing of the smart speaker and create low frequency sound waves that increase the base response of the speaker without including a voice coil or magnet assembly that is included in the active speaker. While the passive radiator array can include any reasonable number of individual passive radiators distributed radially around the enclosure at equally spaced intervals, in some embodiments two passive radiators are included within the housing in an opposing relationship, which beneficially results in a force cancelling design. Also, in addition to heat spreader 800 being at least partially positioned between the passive radiators, the active driver (or a portion of the active driver) can be disposed between the spaced apart passive radiators.

Figure 9A:
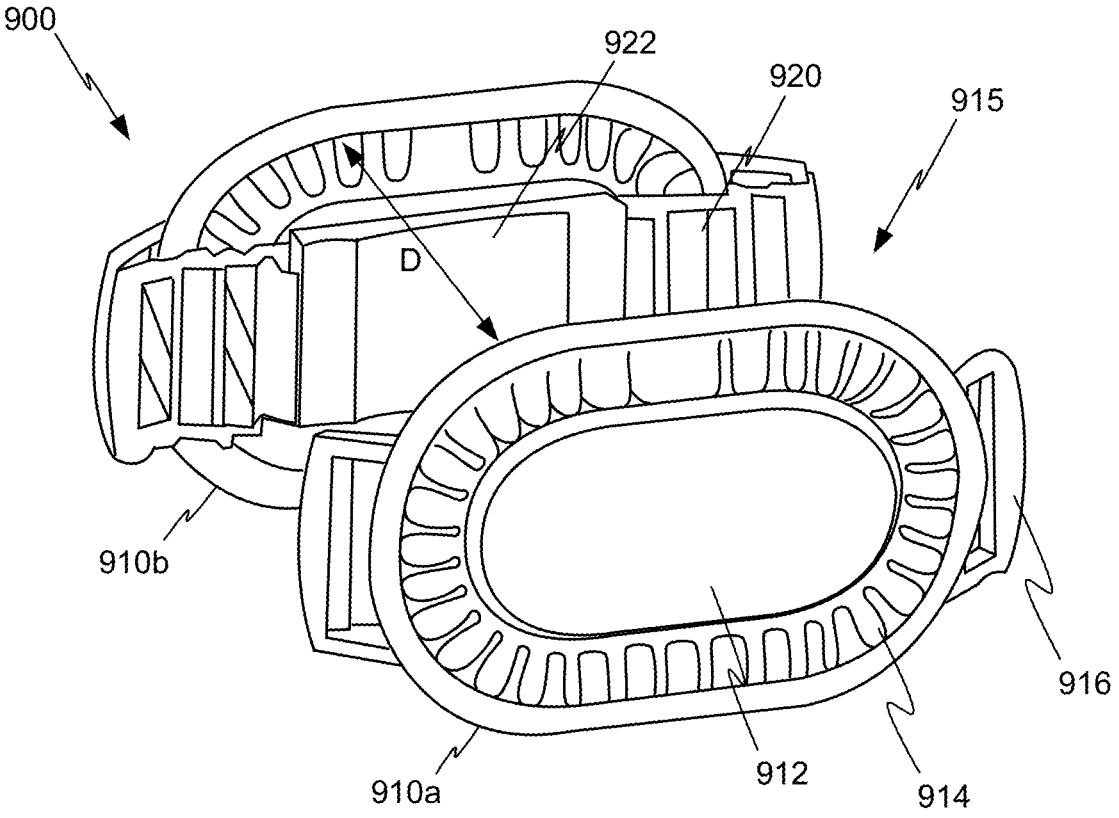
FIG. 9A shows a perspective view of an embodiment of a passive radiator array according to some embodiments.
Figure 9B:
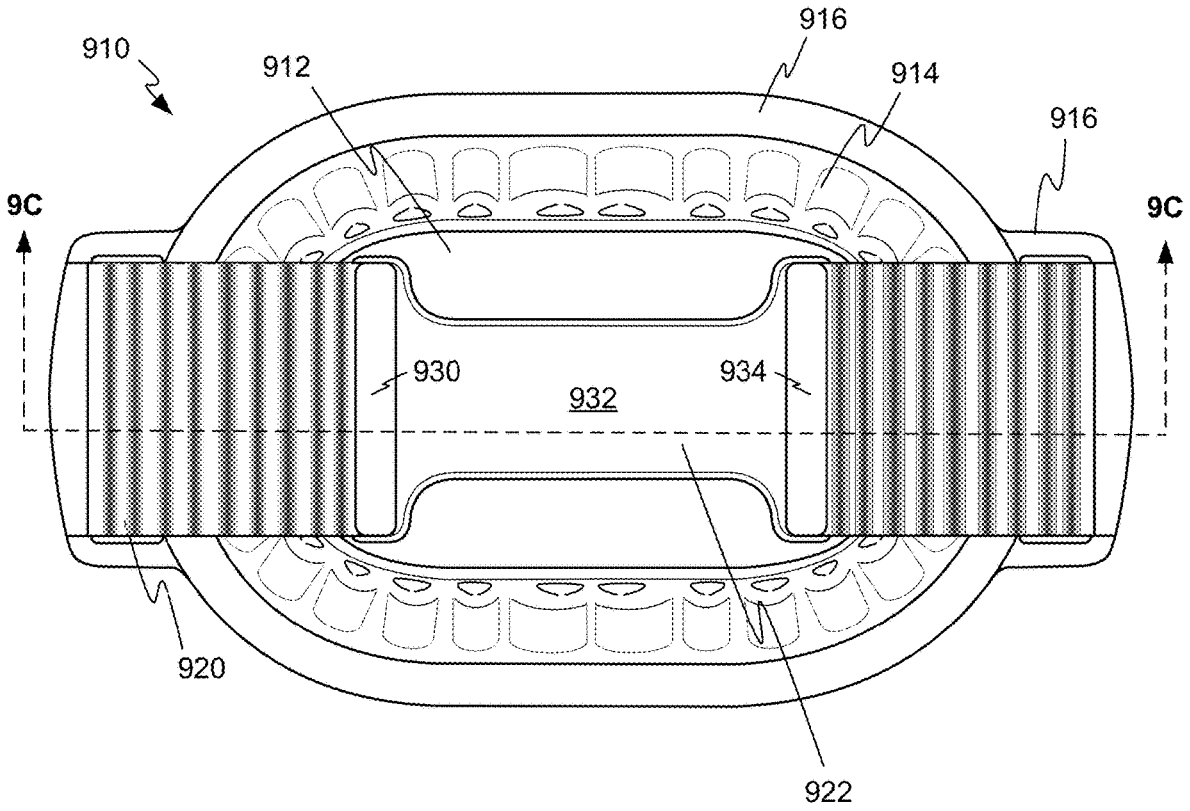
FIG. 9B is a simplified rear plan view of one of the passive radiators in the passive radiator array shown in FIG. 9A.
Figure 9C:
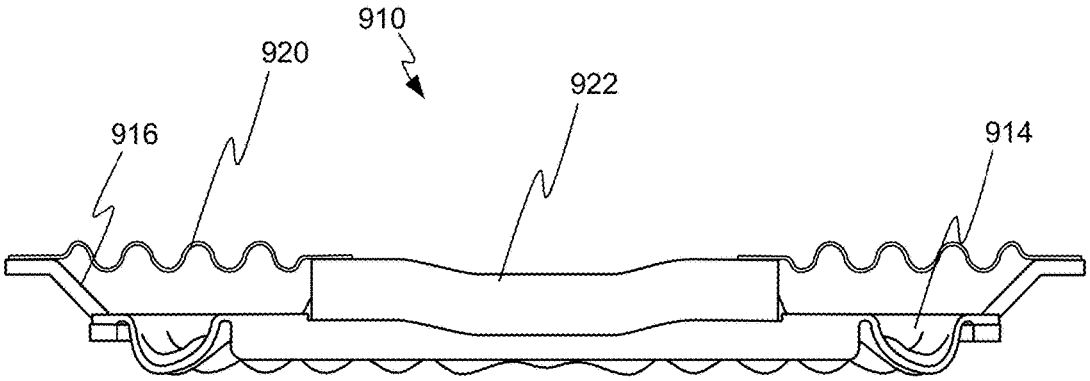
FIG. 9C shows a cross-sectional view of the passive radiator shown in FIG. 9B.

Reference is now made to FIGS. 9A-9C where FIG. 9A is a simplified perspective view of a passive radiator array 900 that includes first and second passive radiators 910*a* and 910*b* positioned in an opposing relationship, FIG. 9B is a back plan view of the passive radiator 910*a* shown in FIG. 9A, and FIG. 9C is a top plan view of passive radiator 910*a*. Due to space constraints imposed by the speaker housing (e.g., housing 200) in some embodiments, passive radiators 910*a* and 910*b* have a unique and efficient shape to both fit within the housing and create the desired low frequency audio components for the compact speaker. As shown in FIG. 9A, passive radiators 910*a* and 910*b* can be essentially identical to each other and spaced apart in an opposing relationship from each other by a distance, D. In some embodiments, distance D is larger than the width, W1, of horizontal surface 802 and/or a width, W2, of sidewall 806, and/or the diameter of the voice coil or magnet assembly that is included in the active speaker. While not shown in FIG. 9A, each of the two passive radiators 910*a*, 910*b* can be positioned directly adjacent to an arrangement of slots 730 or other openings that allow sound waves to pass through the sidewall 704 of middle housing 700.

Each of passive radiators 910*a*, 910*b* can include a central diaphragm 912 surrounded by a primary suspension 914 that can be connected to frame 916. Frame 916 can be mechanically secured to a structural member of the housing 200, such as to an inner perimeter of the upper surface 702 and/or lower surface 706 of middle housing 700 that define apertures through the upper and lower surfaces, respectively. A secondary suspension can be provided by spider members 920 that couple a radiator mass 922 to frame 916. The secondary suspension system provides rotational stiffness to the passive radiators while reducing unwanted rotational vibrations.

The compact design of housing 200 limits the clearance between the passive radiators 910*a*, 910*b* and the active speaker driver 234. To provide sufficient mass for radiator mass 922 to enable the passive radiators to generate desired low frequencies, and to provide sufficient bonding surface of spider members 920 to the radiator mass 922, in some embodiments mass 922 has a dog bone shape to it. For example, as shown in FIG. 9B, first and second opposing ends 930, 934 of mass 922 can have a wider width than a central portion 932 of the mass. Additionally, as shown in FIG. 9C, radiator mass 922 can have a slight concave shape to such that additional space is provided between the central portions 932 of the two passive radiators 910*a*, 910*b* as compared to the space between the corresponding end portions of the two passive radiators. The additional space provided by the narrowing of central portion 932 and the concave nature of the passive radiators allows active driver 234 to be slightly larger than otherwise would be possible and allows other components to be fit inside of housing 200, all of which can result in improved sound quality from the small, compact size of the speaker.

In some embodiments, the spider members 920 can be made from a rubber material that has been thermally compression molded into a wavy pattern that includes a series of adjacent peaks and valleys coupled together to define a single unitary structure as seen in FIG. 9C. In some embodiments, the spider members 920 can have a rectangular shape and be between 0.2 and 2.0 millimeters thick, and approximately 1.0 to 1.2 millimeters thick in some instances. The spider members 920 allow for the support frame 914 to provide rotational stiffness by reducing any unwanted rotation vibrations generated within the interior cavity of the speaker housing, such as interior cavity 205. Respective spider members 920 can be coupled by a coupling mechanism, such as a silicone based glue, to first and second ends 930, 934 of radiator mass 922. In some embodiments radiator mass 922 is a unitary piece of metallic material that has been formed into a dog bone shape with portions removed, cutouts, on a top side and bottom side of the radiator mass as described above and shown in FIG. 9B. The cutouts allow for the accommodation of a portion of the audio driver 234 to be disposed between each of the passive radiators 910*a*, 91*b* in a space or region 915. In some embodiments, radiator mass 922 is made of stainless steel that is considerably thicker than the thickness of the spider members 920. In some embodiments, passive radiator array 900 can be positioned inside interior cavity 710 in a manner such that each passive radiator is aligned with sound channel 730 formed in sidewall 704 of middle housing 700 so that sound waves generated from the passive radiator array 900 can be directed out of slots in the sound channel 730.

Bottom Enclosure

Figure 10A:
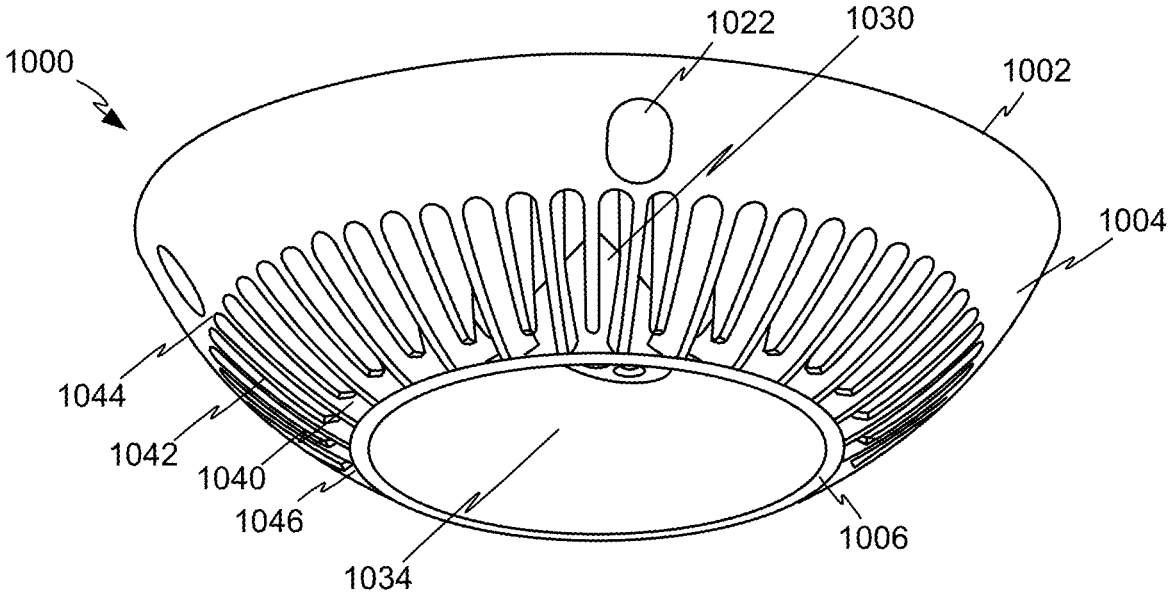
FIG. 10A is a bottom up perspective view of a bottom enclosure of a compact smart speaker according to some embodiments.
Figure 10B:
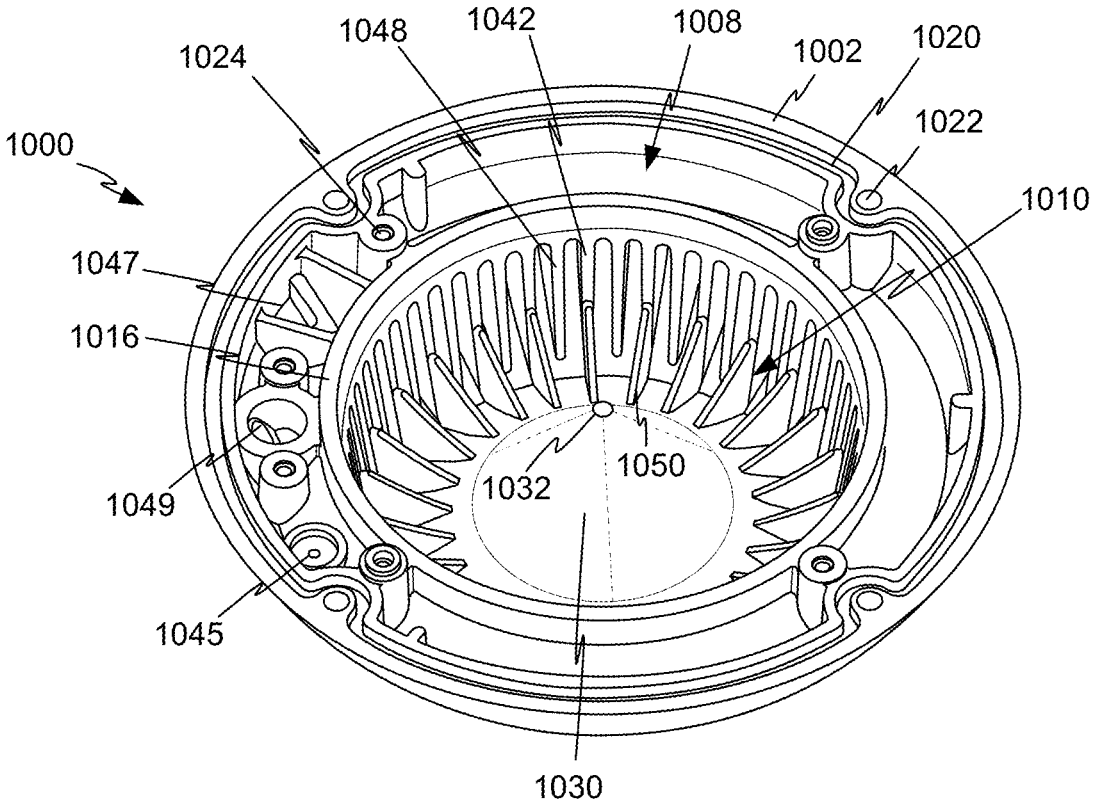
FIG. 10B is a top down perspective view of the bottom enclosure shown in FIG. 10A.

FIG. 10A is a simplified bottom perspective view of a lower housing 1000 according to some embodiments, and FIG. 10B is a simplified top perspective view of lower housing 1000. Lower housing 1000 can be representative of lower housing 230 discussed above with respect to FIG. 2 and can be part of the overall housing of a compact smart speaker, such as compact smart speaker 100. Referring to both FIGS. 10A and 10B, lower housing 1000 can have a generally inverse conical shape and include a sidewall 1004 that extends fully around an outer periphery of the housing between an upper surface 1002 and a lower surface 1006. Sidewall 1004 defines an interior cavity 1010 that opens to an aperture 1008 at top surface 1002. In some embodiments, lower housing 1000 can be a unitary structure made of a solid and stiff plastic polymer with a substantially smooth outer finish. Lower housing 1000 can be made of the same or different plastic polymer as upper housing 500 and/or middle housing 700.

Lower housing 1000 can be mechanically secured to middle housing 700 by various attachment features. As an example, lower housing 1000 can include a channel 1020 that runs along a periphery of upper surface 1002 inset slightly from an outer perimeter of the lower housing. Middle housing 700 can include a rim along its bottom surface that aligns with and fits within channel 1020. Additionally, middle housing 700 can include fastener holes that align with holes 1022 on lower housing 1000 that are spaced evenly apart at 90 degree intervals between channel 1020 and the outer periphery. Mechanical fasteners, such as screws, can be inserted through holes 1022 and threaded into the corresponding holes on middle housing 700 to afix the two housing components together. In some embodiments a thin flexible seal (FIG. 10C, 1060) can be placed in channel 1020 between the channel and the rim on middle housing 500 to acoustically seal the connection between the two components. In still other embodiments, a thicker seal can be placed in channel 1020 that is slightly thicker than the depth of the channel. Middle housing 500 can then include a substantially planar mating surface that aligns with the outer perimeter of upper surface 1002 and covers perimeter channel 1020 including the relatively thick seal. When the middle housing is clamped to the lower housing (e.g., by screws that affix the two components together), the seal compresses into the channel under the compression force and remains in contact with the mating surface of the middle housing.

Since the middle housing can be mechanically secured to upper housing 500 and lower housing 1000, the three separate upper, middle and lower housing components can combine to create an overall device housing for a smart speaker that includes a continuous interior cavity running through all three housing components. While the continuous cavity can be interrupted by various structural members of the different housing components (e.g., structure members shown in the figures of this disclosure), the interior cavity provides space for an audio driver (e.g., speaker), control circuitry and other electronics, a passive radiator array, a heat sink, and a user interface among other components. In some embodiments the audio driver can be mechanically secured to an upper surface of lower housing 1000, such as inner rim 1016, and positioned such that the audio driver diaphragm faces directly downward (see FIG. 10C). For example, lower housing 1000 can include screw holes 1024 spaced radially apart along an inner perimeter of the housing inset from channel 1020. In some embodiments, screw holes 1024 can be located at the same radial positions, and thus aligned with, as openings 1022. The audio driver can include fastener features (e.g., holes or u-shaped hooks) that align with screw holes 1024 and enable the audio driver to be secured to lower housing 1000.

The bottom portion of lower housing 1000 can include a conical portion 1030 that extends upward into cavity 1010 as shown in FIGS. 10A and 10B. Conical portion 1030 is centered within the lower housing and projects upward directly towards the diaphragm of the audio driver to a tip 1032. In this manner, conical portion 1030 receives and redirects air pressure generated by the diaphragm of the audio driver 234 radially outward and towards a lower side portion of lower housing 1000. In some embodiments the surface of conical portion 1030 within cavity 1010 as it extends from tip 1032 to the bottom of the conical section is sloped at an angle between 5 and 45 degrees and between 10 and 30 degrees in other instances.

Figures 10C, 10D:
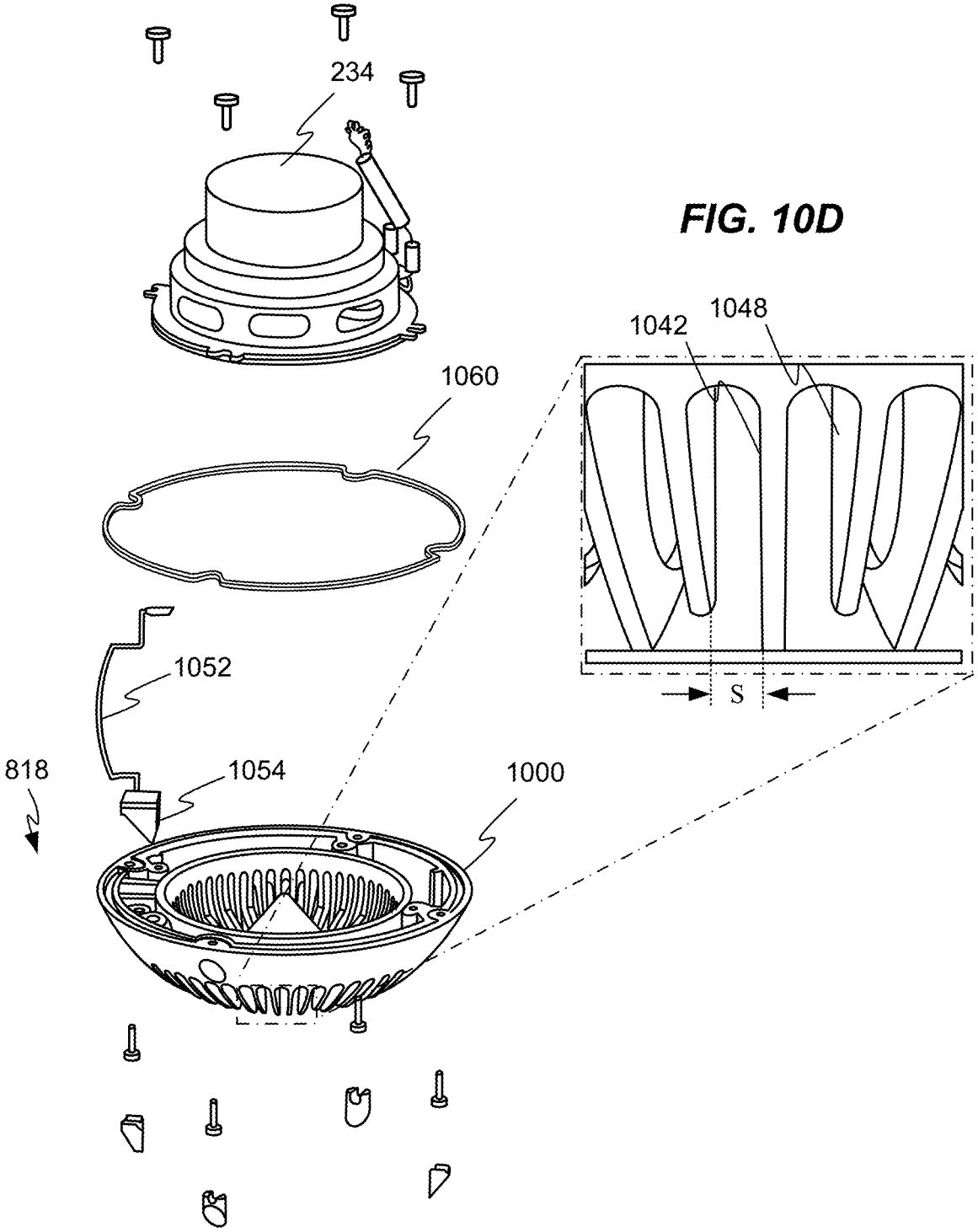
FIG. 10C is an exploded view of various components housed inside a smart speaker according to some embodiments.
FIG. 10D is an expanded view of a portion of FIG. 10C.

The redirected sound waves can exit housing 1000 through an annular opening 1040 formed around the lower portion of sidewall 1004. Annular opening 1040 can extend around an entire periphery of lower housing 1000 to provide a large acoustic area for sound from acoustic driver 234 to exit the housing. A large number of evenly spaced ribs 1042 can extend completely across the annular opening 1040 from a top edge 1044 of the opening to a bottom edge 1046 of the opening providing beneficial structure to the lower housing and maintaining a physical connection between sidewall 1004 and bottom surface 1006 across opening 1040. Ribs 1042 also provide support for the acoustic fabric (e.g., acoustic fabric 250) that can be wrapped around the housing. To provide additional support for the acoustic fabric, an additional set of ribs 1048 can be positioned between ribs 1042 that extend from top edge 1044 of the sidewall 1004 partially into the annular opening 1040 terminating at a location spaced apart from bottom surface 1006 as shown in FIGS. 10A and 10B. In some embodiments ribs 1042 and 1048 are spaced between 1-5 mm apart from each other as shown in FIG. 10D by spacing S, and in some embodiments the rib spacing, S, is between 2-3 mm. The spacing of the ribs, position and shape of conical portion 1030 and position of audio driver 234 can provide omnidirectional sound with increased high frequency output from the speaker. In some embodiments ribs 1042 can include an angled portion 1050 where the rib is attached to the outer periphery of conical portion 1030. As seen in FIG. 10D, the various ribs 1042, 1048 can include an alternating pattern of a long rib 1042 disposed adjacent to a short rib 1048. In some embodiments, long rib 1042 curves inward as it extends downwards towards bottom surface 810 to form angled portions 1050 while short rib 1048 does not include a similar curved section.

Referring back to FIG. 10B, in some embodiments, a barometric mesh 1045 can cover a port formed through lower housing 1000 that helps the internal pressure of the smart speaker equalize. Additionally, a second port 1047 can be formed through the lower housing where a a flex circuit (shown in FIG. 10C as flex circuit 1052) can exit the internal volume and provide sensor values (e.g., from a reference microphone and a temperature and humidity sensor) from the environment to internal components of the smart speaker, such as components on the control board. Referring now to FIG. 10C, at the end of flex circuit 1052 can be an acoustic seal or plug 1054 that can be, for example, made from a rubber or similar compliant material that includes a slit in its middle to allow the flex to extend through the through the seal. A temperature humidity sensor and a reference microphone (neither of which are shown) can be positioned adjacent to the seal near port 1047. In some embodiments the reference microphone can be a digital microphone placed in the front volume of the smart speaker. An additional port 1049 can be positioned near port 1047 to allow for a power cable (e.g., cable 1300 shown in FIG. 13). Positioning the reference microphone near the power cable can help isolate the microphone from a user's voice since, in a typical use case scenario, the smart speaker is likely to be positioned with the power cable away facing a wall or at least facing away from an area where user's congregate.

Foot Structure

Figure 11A:
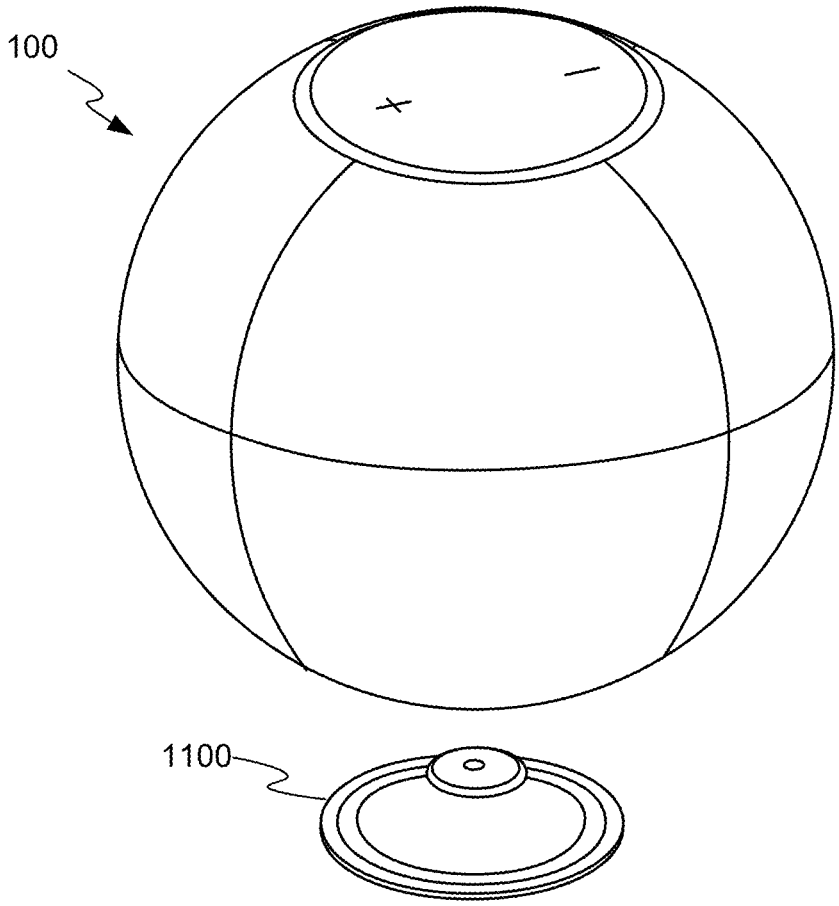
FIG. 11A is a simplified exploded view of an embodiment of a foot assembly that can be coupled to and support a compact speaker according to some embodiments.
Figure 11B:
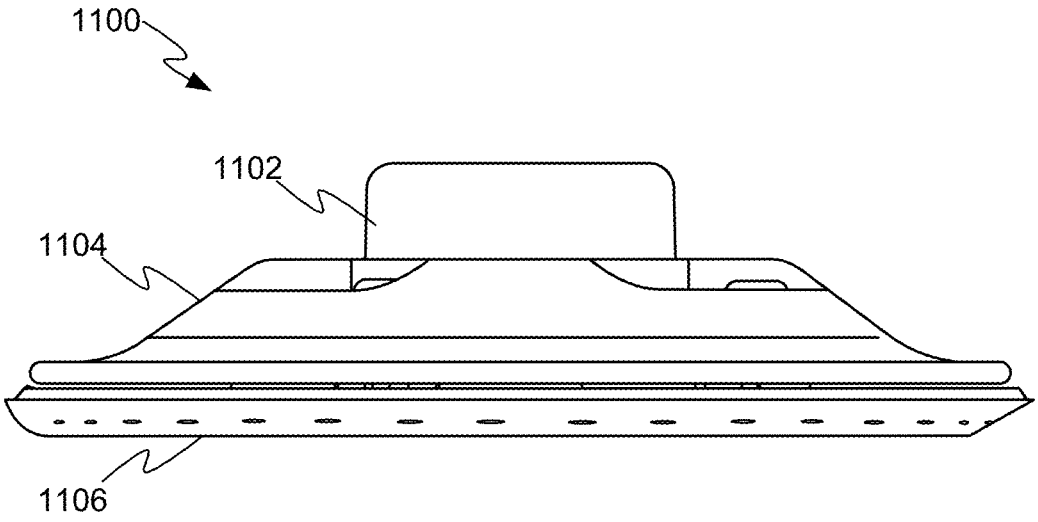
FIG. 11B is a simplified side plan view of the foot assembly depicted in FIG. 11A.

FIG. 11A illustrates a perspective partially exploded view of a foot assembly 1100 that can be coupled to a compact smart speaker 100 according to some embodiments. Foot assembly 1100 can be an implementation of foot assembly 240 discussed above with respect to FIGS. 2A-2D. Foot assembly 1100 is configured to support the weight of compact smart speaker 100 above a supporting surface, such as a desk or table top. Foot assembly 1100 is also configured to isolate vibrations propagating through the smart speaker 100 and prevent the lateral movement or hopping of the speaker across the supporting surface when the speaker is in operation. As shown in FIG. 11B, which is a simplified side view of foot assembly 1100, the foot assembly includes a neck 1102 that enables the foot assembly to be attached to the housing of smart speaker 100, a planar foot 1106 and an exterior sidewall 1104 that is angled upwards from foot 1106 towards neck 1102. In some embodiments the profile of sidewall 1104 enables a substantial majority of foot assembly 1100 to be concealed from a user when the foot is attached to speaker 100 as the sidewall 1104 can fit within the sloped recess 1034 formed at the bottom surface 1006 of lower housing 1000 by conical portion 1030.

Foot 1106 can be a planar foot that is designed and intended to be a single dispersed point of contact with the supporting surface upon which the speaker 100 is placed. As discussed above, some compact speaker designs include multiple small feet spaced apart along a bottom surface of the speaker (e.g., at the corners of a rectangular speaker or along an inner radius of the bottom portion of a circular speaker) to raise the compact speaker off its supporting surface. Each of the multiple small feet presents a concentrated point of contact with the supporting surface that, over time, can damage the supporting surface by causing an indentation, scratch or other disfiguring mark on the surface. Instead of having multiple, smaller concentrated points of contacts with the supporting surface that are the result of multiple small feet, embodiments of the disclosure provide a single wide area foot that has a planar bottom surface that can be positioned on a supporting surface of a desk, table or other structure such that the entire planar surface of the singular foot is in physical contact with the supporting surface.

While such a design provides benefits in reducing the chances that the compact speaker may mark or otherwise damage the supporting surface, having a single, wide area contact foot presents other challenges. For example, when speaker 100 is playing music or otherwise under a working condition, electromagnetic forces are generated between the speaker coils and permanent magnets as electrical signals that pass through the coils of the speaker. The moving parts of the speaker (e.g., the coils and diaphragm) vibrate in response to the electromagnetic forces. Due to the large contact area between the foot and the supporting surface, any such vibrations generated by the speaker that are transmitted to the foot can cause an undesirable buzzing noise or cause the entire speaker to vibrate sufficiently that the speaker can shift positions and move or hop across the supporting surface. Obviously, either such buzzing noises or movement can be undesirable. In some embodiments the planar foot can be made from a glass filled polycarbonate material. Additionally, and as described below, embodiments of the disclosure provide a internal suspension system within foot 1100 that dampen vibrations from the speaker improving the stability of the speaker and preventing or greatly reducing the likelihood that any such vibrations will be sufficient to move the speaker.

Figure 12A:
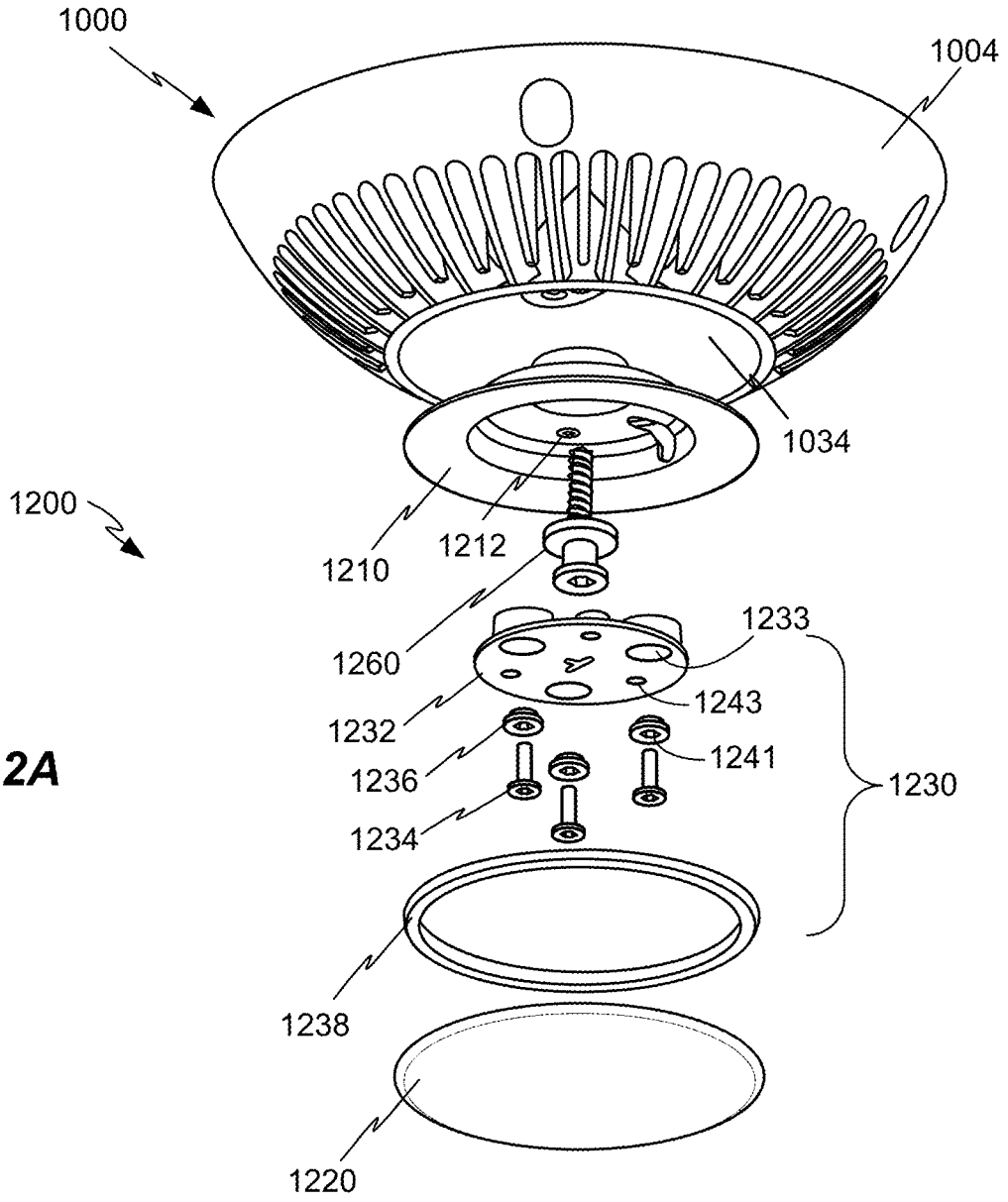
FIG. 12A is an exploded view of various components housed inside a smart speaker according to some embodiments.
Figure 12B:
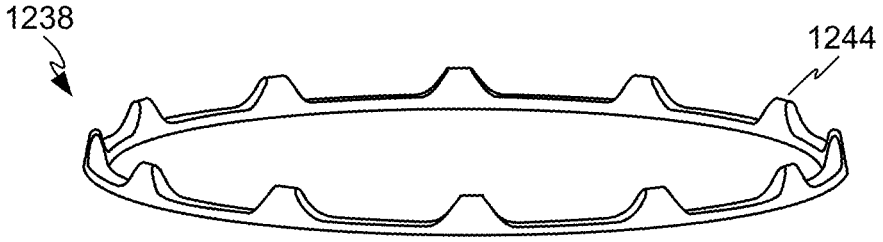
FIG. 12B is a simplified perspective view of an isolation ring that can be included in a smart speaker according to some embodiments.
Figure 12C:
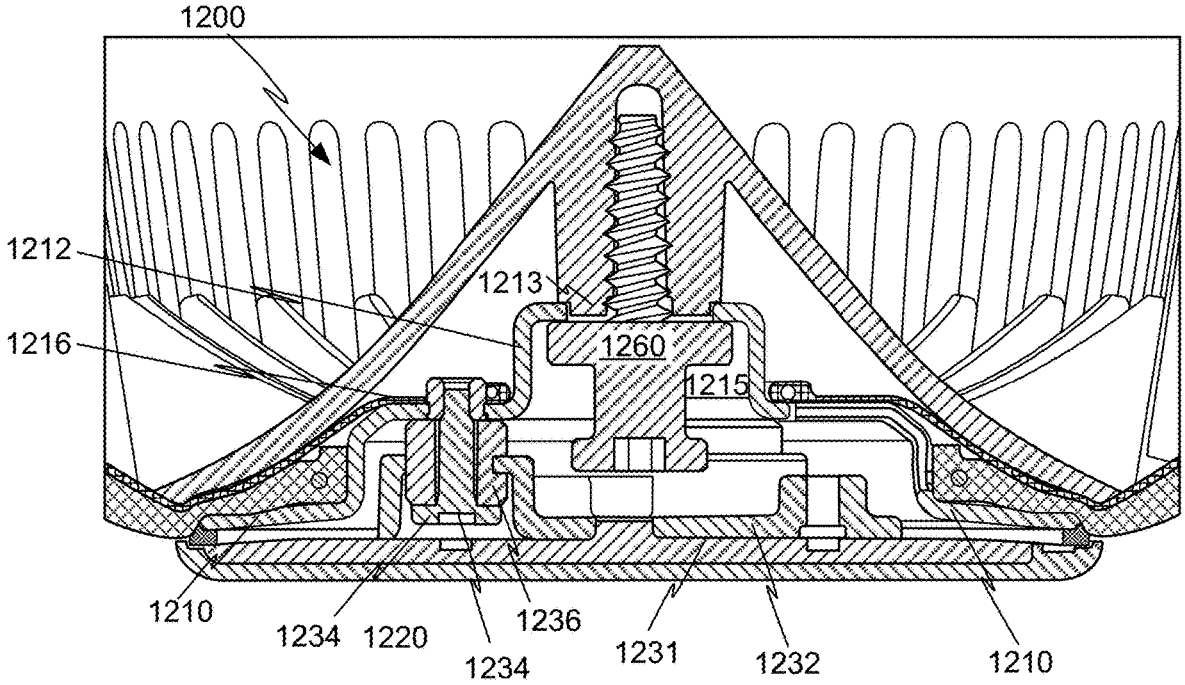
FIG. 12C is a simplified cross-sectional view of a foot assembly according to some embodiments.
Figure 12D:
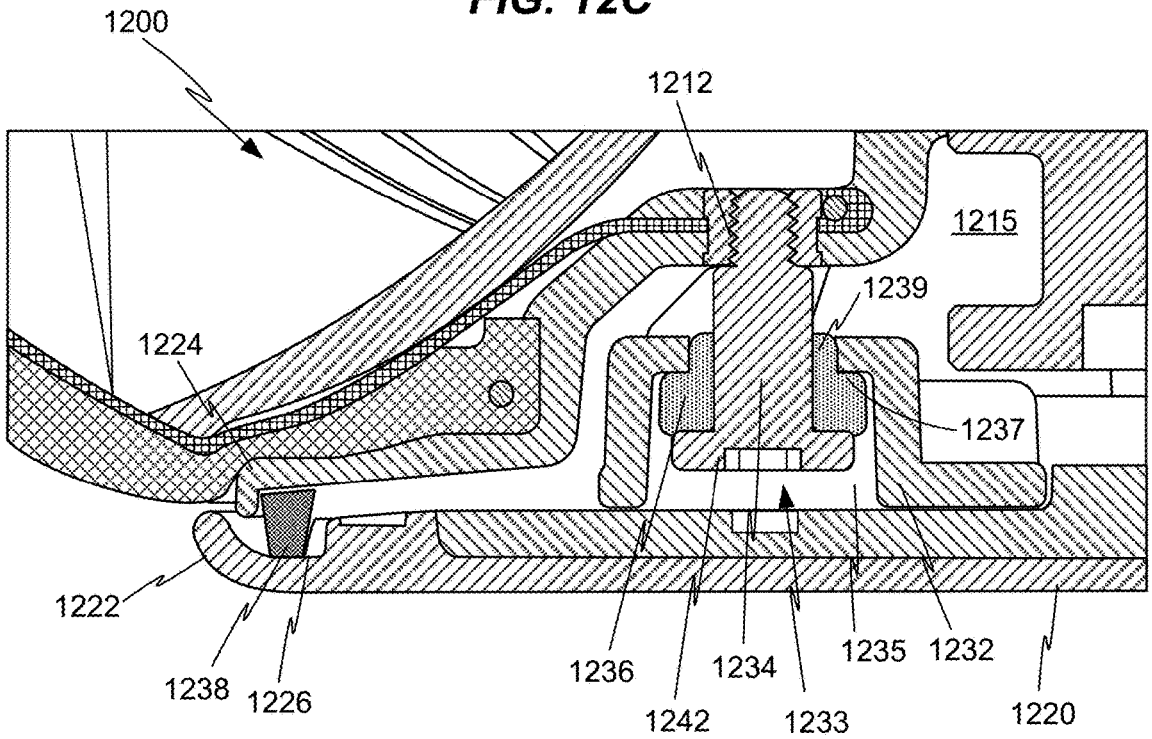
FIG. 12D is an expanded simplified cross-sectional view of a foot assembly according to some embodiments.

Reference is made to FIGS. 12A-12D, collectively, where FIG. 12A is a simplified exploded perspective view of a foot assembly 1200 that can be an implementation of foot assembly 1100, FIGS. 12C and 12D are simplified cross-sectional views of portions of foot assembly 1200 according to slightly different embodiments and FIG. 12B is a perspective view of an isolator ring that can be included within foot assembly 1200 in some embodiments. As shown in FIGS. 12A-12D, foot assembly 1200 includes an anchor 1210 and a planar foot 1220. Anchor 1210 can include a central neck 1212 with an aperture 1213 formed through an upper surface of the neck, a sidewall 1214 surrounding and extending radially away from the neck to an annular edge, and a plurality of fastener openings 1216 formed along the sidewall 1214. In some embodiments, anchor 1210 can provide clamp the acoustic fabric (e.g., acoustic fabric 250) in place and can also provide a mounting surface for the foot suspension system as discussed below.

Anchor 1210 can be mechanically secured to lower housing 1000 by a fastener, such as anchor screw 1260, which can extend through neck 1212 and aperture 1213 and mate with a corresponding threaded hole centrally disposed at bottom surface of lower housing 1000, e.g., formed by the structure of conical portion 1030. Once attached, the anchor fits within hollowed out space 1034 of lower housing 1000 by conical portion 1030. In this manner, foot assembly can be largely hidden within the lower housing. In a fully assembled state, planar foot 1220 can spaced apart from anchor 1210 in an opposing relationship. The planar foot 1220 can have an outer perimeter 1222 proximate an annular edge 1224 of anchor 1210. Planar foot 1220 can also include an annular channel 1226 inset from outer perimeter 1222 and within a circumference of anchor sidewall annular edge 1224.

An upper surface of planar foot 1220 can cooperate with an interior surface of anchor 1210 to create an internal cavity 1215 within the foot assembly 1200. A suspension system 1230 can fit within foot assembly cavity 1215 between the planar foot and the anchor fastener and couple anchor 1210 to the planar foot 1220. Suspension system 1230 can be operable to dampen vibrations generated by the audio driver disposed within the speaker housing and allows planar foot 1220 and anchor 1210 move with respect to each other. For example, when compact speaker including suspension system 1230 is picked up and placed on a supporting surface, the weight of the compact speaker can force suspension system to compress such that anchor 1210 (and thus the speaker) moves towards foot 1220.

Suspension system 1230 can include an isolator plate 1232, a plurality of isolator fasteners 1234, a plurality of isolator stops 1236, and an annular isolator ring 1238. The isolator plate 1232 can be mechanically attached to the planar foot (for example, by one or more fasteners 1235 that extend through holes 1243), and can include a lower planar surface 1231 facing the planar foot and a plurality of channels 1233 projecting perpendicularly away from planar surface 1231 towards the device housing 1000. Each of the plurality of channels 1233 can include an inner perimeter surface 1225 extending from planar surface 1231 to a terminating surface 1237. Each channel 1233 can further include an aperture 1239 formed through a central location on terminating surface 1237. Each of the isolator stops 1236 can be fitted within one of the channels 1233 and can include an aperture 1241 bisecting a length of the isolator stop 1236.

The isolator stops 1236 can provide a soft limit to the distance planar foot 1220 can travel away from the housing when it is not loaded. In some embodiments, the isolator stops limit the travel when the planar foot is unloaded such that the isolator ring 1238 is still loaded. In doing so planar foot 1220 does not feel loose to a user holding the speaker. Then, when the planar foot 1220 is loaded (e.g., when the speaker is placed upon a table top), the isolator stops 1236 can disengage in the axial direction and only provide centering to the isolator fasteners 1234. By being disengaged in the axial direction the stiffness of suspension system 1230 can be defined by the stiffness of isolator ring 1238.

Each of the isolator fasteners 1234 can be disposed within one of the plurality of channels 1233 extending through the isolator stop aperture 1241 and channel aperture 1239 of its corresponding channel 1233 into one of the fastener openings 1212 formed in the sidewall (e.g, sidewall 1104) of anchor 1210 to mechanically attach the isolator fastener to the sidewall, and wherein each isolator fastener is operable to translate within its respective channel. In some embodiments, fasteners 1234 can be can be a screw or a bolt. The end 1242 of each isolator fastener opposite end where the fastener couples to anchor 1210 can be slightly wider than the aperture in isolator stop 1241 and can be slidably moved within the aperture stop. This, combined with a small air gap between the end of each isolator fastener 1234 and planar foot 1220, allows each isolator fastener to translate within its repsective channel under the weight of the speaker forcing end 1242 towards planar foot 1220. Opposing this movement is annular isolator ring 1238.

The annular isolator ring 1238 can be made from a low durometer compressible material, such as a silicone material. The isolator ring 1238 can be disposed with the annular channel 1226 at the upper surface of planar foot 1220 between the planar foot and an outer peripheral portion 1224 of anchor 1210. An edge or lip of peripheral portion 1224 can extend into a portion of channel 1226 to conceal isolator ring 1238 from view. The annular isolator ring 1238 can compress under the weight of the speaker allowing the isolator fasteners 1234 to move down in their respective channels 1233 towards foot 1220. Isolator ring 1238 is chosen to have a thickness and compressibility that supports the weight of the speaker keeping the speaker suspended over support plate 1220 by the isolator ring. Thus, isolator ring 1238 prevents the rigid surfaces of anchor 1210 from contacting the rigid surfacers of planar foot 1220 under normal operating conditions thereby isolating vibrations from within the speaker before they reach planar foot 1220. In some embodiments, isolator ring 1238 can include a number of teeth 1244 distributed along its periphery. Each tooth 1244 can have a consistent shape and thickness. In some embodiments the isolation ring 1238 can be positioned in annular channel 1226 with teeth 1244 facing downwards into the channel towards planar foot 1220. In other embodiments, the teeth 1244 can face upwards towards the top of the smart speaker.

Power Receptacle

Figure 13:
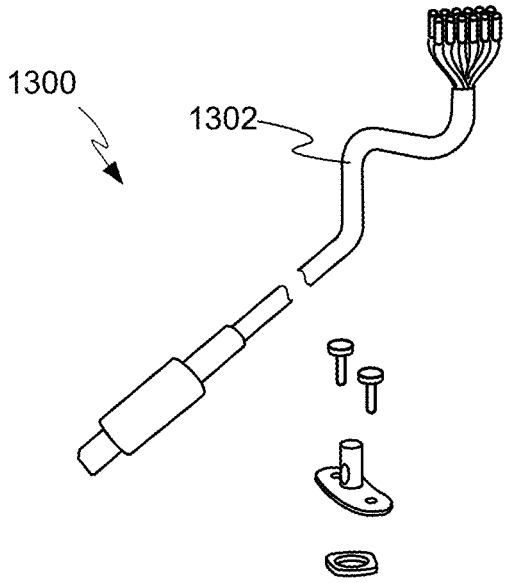
FIG. 13 is an exploded perspective view of a power cable assembly for a smart speaker according to some embodiments.
Figure 14:
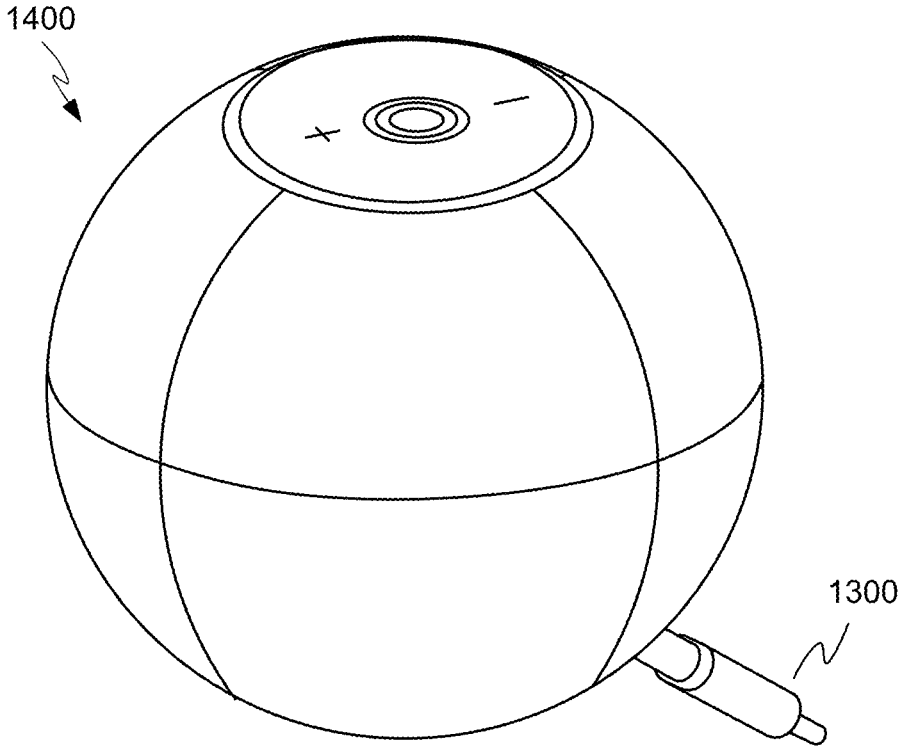
FIG. 14 is a simplified perspective view of an embodiment of a smart speaker with the power cable depicted in FIG. 13 assembled.

FIG. 13 illustrates a power receptacle 1300 which can extend into the space between passive radiators 910*a*, 910*b* in some embodiments to route power from an outside power source to various components within the compact smart speaker. Power receptacle 1300 can be electrically coupled to a power supply unit (not shown) of main logic board (e.g., board 124) by an electrically conductive cable 1302. FIG. 14 is a simplified illustration of a smart speaker 1400 with power receptacle 1300 coupled to a lower portion of the speaker.

Processor and Control Circuitry

Figure 15:
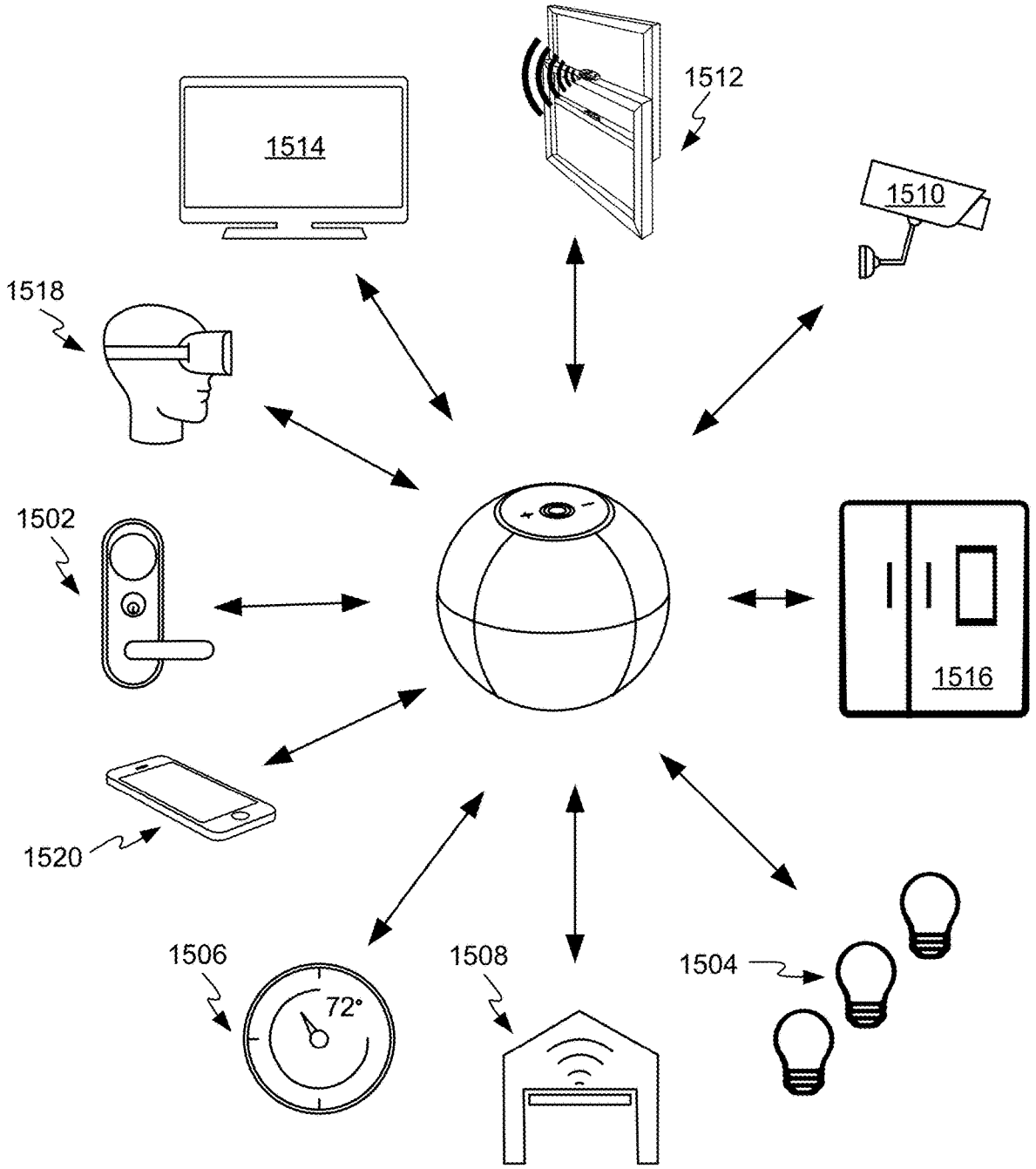
FIG. 15 is a diagram indicating different types of connected electronics that can communicate and/or interact with a smart speaker in accordance with embodiments of the disclosure.

FIG. 15 shows a diagram indicating different types of connected electronics that can communicate and/or interact with speakers disclosed herein, such as speaker 100. In some embodiments, the disclosed speaker (referred to generically below as speaker 100 for convenience) can act as a central hub to facilitate home automation. Memory on-board speaker 100 or memory accessible through a network, which is accessible by speaker 100, can be used to store rules governing the interaction of the various depicted device types. Speaker 100 can then send instructions to the disparate devices in accordance with the stored rules. Microphones disposed within speaker 100 can be configure to receive voice commands to carry out specific actions related to connected electronics within a user's home. In some embodiments, convex user interface can receive commands for adjusting various settings on a particular connected electronic device. For example, speaker 100 can be configured to receive commands to make adjustments to smart locking device 1502. In some embodiments, speaker 100 can include instructions allowing it to lock and unlock smart locking device 1502 in response to a voice command. Furthermore, speaker 100 can be configured to alert occupants within a house that smart locking device 1502 has been unlocked. In some embodiments, speaker 100 can announce the identity of the user who unlocked smart locking device 1502. In such a circumstance, smart locking device 1502 can be configured to open in response to a command received from an electronic device such as a mobile phone. Speaker 100 can then identify the user when a user is associated with that mobile phone. In some embodiments, speaker 100 can be configured to interact with other devices in response to actuation of smart locking device 1502. For example, speaker 100 could direct the illumination of one or more of lights 1504 and adjust a temperature of an HVAC system associated with smart thermometer 1506 in response to the unlocking event.

FIG. 15 also shows communication between speaker 100 and smart garage opener 1508. In response to detecting an opening event of smart garage opener 1508, speaker 100 could be configured to perform similar actions described above with respect to the operation of smart locking device 1502. In some embodiments, different ones of lights 1504 could be illuminated in anticipation of the user entering the housing from a different direction.

Speaker 100 could also be configured to operate different smart devices in accordance with various calendar events associated with an electronic calendar. For example, the speaker could be configured to disable surveillance camera 1510 during an event located in the same room as surveillance camera 1510 when that event is marked as private. Speaker 100 could also be configured to notify one or more users if window sensor 1512 indicates a window remains open after a particular time of day or night. In some embodiments, speaker 100 can act as a media hub cooperating with other components such as television/monitor 1514 to present both video and audio content in response to various user inputs and/or smart device activities. For example, televisions/monitor 1514 could present a status screen and/or progress monitor indicating the status and/or activity being performed by other components that may or may not have the ability to present a graphical interface to a user of speaker 100. In some embodiments, speaker 100 could be configured to remotely direct refrigerator 1516 to send the user images of interior areas of refrigerator 1516 shortly before a user has a grocery shopping trip scheduled. While these various operations could be stored in internal memory of speaker 100, speaker 100 can also be in communication with a cloud service provider helping to coordinate various activities with users that may or may not be connected with a local area network with speaker 100. For example, a user could connect remotely with speaker 100 with a device such as a smart phone to activate certain tasks for smart components with which speaker 100 is in communication.

In some embodiments, speaker 100 can be configured to interact with wearable display 1518. Wearable display 1518 can take the form of augmented reality or virtual reality goggles that present digital content to a user. When wearable display 1518 is an augmented reality display, wearable display 1518 can overlay various control interfaces around speaker 100. For example, virtual content could overlay convex user interface atop speaker 100 to make the user interface larger. In some embodiments, the enlarged user interface could include an expanded display and enlarged control manipulation regions that allow a user to control speaker 100 with more efficiently and/or with a greater degree of options.

In some embodiments, wearable display device can be configured to receive optical commands from speaker 100. For example, a display associated with a user interface can be configured to output particular patterns of light. Optical sensors of wearable display device 1518 can identify the patterns of light and in response vary the display in some manner. For example, the type, size and orientation of virtual controls displayed by wearable display 1518 can be varied in accordance with the output of the display associated with the user interface.

Figure 16:
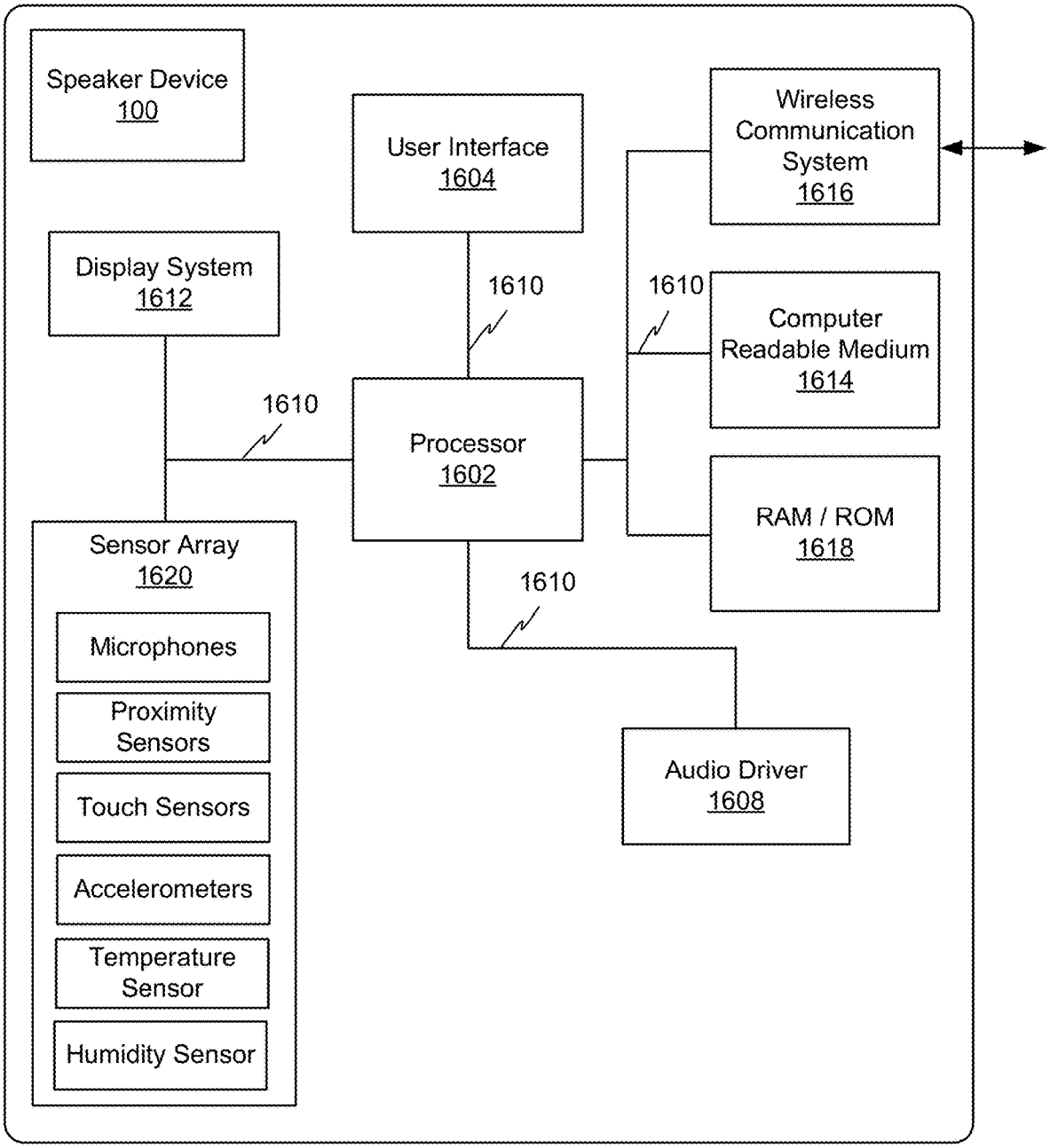
FIG. 16 is a block diagram illustrating communication and interoperability between various electrical components of a smart speaker in accordance with embodiments of the disclosure.

FIG. 16 shows a block diagram illustrating communication and interoperability between various electrical components of speaker 100. Processor 1602 can be in communication with the depicted electrical components. User interface 1604 can receive user inputs that are then received by processor 1602. In response to the user inputs, processor 1602 can interpret and relay signals corresponding to the received user inputs to other electrical components. For example, user interface can receive user inputs directing an increase in output of both subwoofer 1606 and audio driver assemblies 1608. In some embodiments, the electrical components can all be linked together by electrically conductive pathways established by components such as flex connector 1820, which is able to route electrical signals to various electrical components distributed throughout a device housing of speaker 100. Speaker 100 can also include display system 1612. Display system 1612 can be configured to provide visual feedback to a user of speaker 100. For example, the visual feedback can be provided in response to interaction with a voice assistant such as the Siri® voice assistant produced by Apple Inc., of Cupertino, Calif. In some embodiments, an array of colorful mosaic patterns could be presented while a voice request is being processed and/or as the voice assistant is waiting for the voice request. speaker can also include a computer-readable medium 1614. Computer-readable medium 1614 can be configured to store or at least cache an amount of media files for playback by subwoofer 1606 and audio driver assemblies 1608. In some embodiments, the media files stored on computer-readable medium 1614 can include, e.g., movies, TV shows, pictures, audio recordings and music videos. In some embodiments, a video portion of a media file can be transmitted to another device for display by wireless communication system 1616. This could be desirable even when display system 1612 is showing the video portion since another device may have a larger or more easily viewable display for a particular user. For example, the other display device could be selected in accordance with a user's position within a room.

FIG. 16 also shows RAM/ROM component 1618. RAM/ROM component 1618 can include RAM (random access memory) for short term caching of frequently used information and/or information cued just prior to playback. ROM (read only memory) can be used to store computer code such as device drivers and lower level code used in the basic operation of speaker 100. In some embodiments, RAM/ROM component 1618 can take the form of two separate components.

FIG. 16 also shows how speaker 100 can also include a sensor array 1620 that includes microphones, proximity sensors, touch sensors, accelerometers, temperature sensors, humidity sensors and the like. Microphones of sensor array 1620 could be configured to monitor for voice commands. In some embodiments, the microphones could be configured to process voice commands only after recognizing a command phrase indicating the user's intent to issue a voice command. Microphones can be interspersed radially along the outside of the device housing so that the housing doesn't mask or obscure the voice commands. Multiple microphones can also be utilized to triangulate a position of a user within the room. In certain instances it may be desirable to optimize audio output or cue additional smart devices (see FIG. 15) in accordance with a determined location of the user.

In addition to identifying a user's location by triangulation with spatially dispersed microphones, proximity sensors can be distributed along the exterior surface of speaker 100 in order to help identify the presence of users and/or obstructions surrounding speaker 100. In some embodiments, the proximity sensors can be configured to emit infrared pulses that help characterize objects surrounding speaker 100. The pulses reflected back to the sensor can be processed by processor 1602, which can then make a characterization of any objects surrounding speaker 100. The reflected pulses and audio triangulation data can be combined to further refine the position of a user delivering instructions to speaker 100. Sensor array 1620 can also include touch sensors that allow a user to input commands along an exterior surface of speaker 100. For example, touch PCB 1514 of the convex user interface depicted in FIG. 15 is configured to detect user gestures made along top cap 1542 and interpret the gestures as various instructions to be carried out by one or more components of speaker 100.

Sensor array 1620 can also include one or more accelerometers. The accelerometers can be configured to measure any tilt of speaker 100 with respect to a gravitational reference frame. Since speaker 100 is optimized to evenly distribute audio content in a room when positioned on a flat surface, placing speaker 100 on an inclined or declined surface could negatively impact the acoustic output of speaker 100. In response to the accelerometer determining speaker 100 is tilted at an angle of greater than 2 degrees, speaker 100 could be configured to prompt the user to find a flatter surface to place speaker on 100. Alternatively, the speaker can be configured to alter the sound output to compensate for the tilted angle. In some embodiments, accelerometers could also be configured to monitor for any resonant vibrations within speaker 100. Processor 1602 could then be configured to adjust the audio output to help subwoofer 2306 and/or audio driver assemblies 1608 avoid or reduce the generation of frequencies that cause speaker 100 to vibrate at one or more resonant frequencies.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling operation of the compact smart speaker 100. In some embodiments, the computer readable medium can include code for interacting with other connected devices within a user's home. For example, the compact smart speaker 100 could be configured to use its ambient light sensor to identify human activity and to learn when to activate and deactivate certain devices within the user's home. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings. For example, the planar foot structure and suspension system described herein can be used to support an electronic speaker having an internal configuration very different than the single audio driver system described with respect to FIG. 3 and in some embodiments, the disclosed planar foot and/or suspension system can be used in conjunction with an electronic speaker that includes multiple audio drivers, such as an array speaker.

Additionally, it is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. An electronic speaker, comprising:

a device housing defining an interior cavity and including an exterior sidewall extending around the interior cavity between an upper portion and a lower portion of the device housing;

first and second sound channels formed at opposing locations along the exterior sidewall, each of the first and second sound channels comprising a plurality of openings formed through the exterior sidewall;

a passive radiator array comprising first and second passive radiators disposed within the interior cavity, spaced apart from each other in an opposing relationship and aligned to project sound through the first and second sound channels, wherein each of the first and second passive radiators comprises a frame, a radiator mass element and a secondary suspension coupling the radiator mass element to the frame in a manner that allows the radiator mass to move within the frame, and wherein the radiator mass element has first and second opposing ends and a central section extending along a length of the radiator mass element between the first and second opposing ends with a width of each of the first and second opposing ends being greater than a width of the central section;

an active driver disposed in the device housing and configured to generate sound in response to an electrical signal, the active driver comprising driver housing disposed at least partially between the first and second passive radiators, a magnet disposed within the driver housing, a voice coil and a diaphragm facing downwards towards the lower surface of the device housing; and an annular sound channel disposed along the lower portion of the device housing adjacent to the diaphragm of the active driver.

2. The electronic speaker set forth in claim 1 wherein the device housing further includes a cone-shaped inner sidewall projecting away from a bottom portion of the device housing towards the active driver and wherein the exterior sidewall and the annular sound channel surround the cone-shaped inner sidewall.

3. The electronic speaker set forth in claim 1 wherein the lower portion of the device housing comprises a plurality of ribs disposed radially around the device housing and extending from the exterior sidewall towards a bottom surface of the device housing defining a plurality of slits that form the annular sound channel.

4. The electronic speaker set forth in claim 3 wherein the plurality of ribs disposed radially around the device housing includes a first set of ribs extending from the exterior sidewall to the bottom surface of the device housing and a second set of ribs extending partially between the exterior sidewall and the bottom surface of the device housing.

5. The electronic speaker set forth in claim 4 wherein the plurality of ribs disposed radially around the device housing includes an alternating pattern of one or more ribs from the second set of ribs disposed between each adjacent pair of ribs in the first set of ribs.

6. The electronic speaker set forth in claim 3 wherein each rib in the plurality of ribs is spaced equally apart from its adjacent ribs by a distance between 1.0 to 5.0 millimeters.

7. The electronic speaker set forth in claim 1 further comprising a touch responsive input device disposed at an upper surface of the device housing.

8. The speaker set forth in claim 1 further comprising a planar foot coupled to the device housing.

9. The speaker set forth in claim 1 further comprising an acoustic fabric woven in a mesh configuration and wrapped around the device housing providing a consistent exterior surface for the electronic speaker.

10. The electronic speaker set forth in claim 1 wherein the device housing comprises separate upper housing, middle housing and lower housing components affixed to each other to form the interior cavity.

11. The electronic speaker set forth in claim 1 wherein the frame of each of the first and second passive radiators comprises an annular outer rim extending fully around an outer periphery of the frame and first and second connection members protruding from opposing ends of the outer rim.

12. The electronic speaker set forth in claim 11, wherein each of the first and second passive radiators in the passive radiator array further comprises:

a rigid diaphragm disposed within a central portion of its respective frame; and a primary annular suspension coupling the diaphragm to the annular outer rim of the frame in a manner that allows the diaphragm to move within the frame;

wherein the secondary suspension in each of the first and second passive radiators comprises a first spider element coupled between the first connection member of the frame and the first end of its respective radiator mass, and a second spider element coupled between the second connection end of the frame and the second end of its respective radiator mass.

13. The electronic speaker set forth in claim 12 wherein the central section of the radiator mass element has a generally concave shape and wherein radiator mass element is coupled to the secondary suspension such that the concave portion of the radiator mass element is facing away from the diaphragm.

14. The electronic speaker set forth in claim 12 wherein each of the first and second spider elements is formed from a thin sheet of rubber between 1-2 mm thick.

15. The electronic speaker set forth in claim 12 wherein each of the first and second spider elements is thermoformed into a wavy pattern along a length of the spider.

16. The electronic speaker set forth in claim 12 wherein the frame has a generally oval shape and includes first and second connection ends protruding from opposite ends of the frame.

17. The electronic speaker set forth in claim 12 wherein the first spider element is adhered to the first end of the radiator mass element along a first connection portion of the first connection end that has a width greater than a width of the central section, and wherein the second spider element is adhered to the second end of the radiator mass element along a second connection portion of the second connection end that has a width greater than a width of the central section.

18. An electronic speaker, comprising:

a device housing defining an interior cavity and including an exterior sidewall extending around the interior cavity between an upper portion and a lower portion of the device housing;

first and second sound channels formed at opposing locations along the exterior sidewall, each of the first and second sound channels comprising a plurality of openings formed through the exterior sidewall;

a passive radiator array comprising first and second passive radiators disposed within the interior cavity, spaced apart from each other in an opposing relationship and aligned to project sound through the first and second sound channels;

an active driver disposed in the device housing and configured to generate sound in response to an electrical signal, the active driver comprising driver housing disposed at least partially between the first and second passive radiators, a magnet disposed within the driver housing, a voice coil and a diaphragm facing downwards towards the lower surface of the device housing; and an annular sound channel disposed along the lower portion of the device housing adjacent to the diaphragm of the active driver;

wherein the lower portion of the device housing comprises a plurality of ribs disposed radially around the device housing and extending from the exterior sidewall towards a bottom surface of the device housing defining a plurality of slits that form the annular sound channel;

wherein the plurality of ribs includes a first set of ribs extending from the exterior sidewall to the bottom surface of the device housing and a second set of ribs extending partially between the exterior sidewall and the bottom surface of the device housing and arranged in an alternating pattern with the first plurality of ribs such that one or more ribs from the second set of ribs is disposed between each adjacent pair of ribs in the first set of ribs; and wherein the device housing further includes a conical inner sidewall projecting away from a bottom surface of the device housing towards the active driver, the annular sound aperture surrounds the conical inner sidewall, and each rib in the first set of ribs includes an angled portion adjacent to the bottom surface that extends inward towards the conical inner sidewall.

19. An electronic speaker, comprising:

a device housing defining an interior cavity and including an exterior sidewall extending around the interior cavity between an upper portion and a lower portion of the device housing;

first and second sound channels formed at opposing locations along the exterior sidewall, each of the first and second sound channels comprising a plurality of openings formed through the exterior sidewall;

a passive radiator array comprising first and second passive radiators disposed within the interior cavity, spaced apart from each other in an opposing relationship and aligned to project sound through the first and second sound channels, each of the first and second passive radiators comprising: a frame having an annular outer rim extending fully around an outer periphery of the frame and first and second connection ends protruding from opposing ends of the outer rim, a rigid diaphragm disposed within a central portion of the frame, a primary annular suspension coupling the diaphragm to the annular outer rim of the frame in a manner that allows the diaphragm to move within the frame, a radiator mass element having first and second opposing ends and a central section extending along a length of the radiator mass element between the first and second opposing ends where a width of each of the first and second opposing ends is greater than a width of the central section, and a secondary suspension coupling the radiator mass element to the frame in a manner that allows the radiator mass to move within the frame;

an active driver disposed in the device housing and configured to generate sound in response to an electrical signal, the active driver comprising driver housing disposed at least partially between the first and second passive radiators, a magnet disposed within the driver housing, a voice coil and a diaphragm facing downwards towards the lower surface of the device housing;

an annular sound channel disposed along the bottom portion of the device housing adjacent to the diaphragm of the active driver;

wherein the device housing further includes a conical inner sidewall surrounded by the exterior sidewall and the annular sound channel and projecting away from a bottom surface of the device housing towards the active driver.

20. The electronic speaker set forth in claim 19 wherein the secondary suspension comprises a first spider element coupled between the first connection member of the frame and the first end of the radiator mass, and a second spider element coupled between the second connection end of the frame and the second end of the radiator mass.

* * * * *